US006526925B1

(12) United States Patent
Green, Jr.

(10) Patent No.: US 6,526,925 B1
(45) Date of Patent: Mar. 4, 2003

(54) PISTON DRIVEN ROTARY ENGINE

(76) Inventor: Willie A. Green, Jr., 2810 E. John St., Appleton, WI (US) 54914

( * ) Notice: Subject to any disclaimer, the term of this patent is extended or adjusted under 35 U.S.C. 154(b) by 0 days.

(21) Appl. No.: 09/572,391

(22) Filed: May 16, 2000

Related U.S. Application Data

(60) Provisional application No. 60/135,659, filed on May 19, 1999.

(51) Int. Cl.[7] ..... F02B 57/00

(52) U.S. Cl. ..... 123/43 R; 123/44 R

(58) Field of Search ..... 123/44 R, 44 C, 123/44 D, 43 R; 91/197

(56) References Cited

U.S. PATENT DOCUMENTS

| | | | | |
|---|---|---|---|---|
| 1,040,716 A | | 10/1912 | Manrodt | |
| 1,407,659 A | * | 2/1922 | Kemp | 123/44 R X |
| 1,412,091 A | * | 4/1922 | Ricardo | 123/44 R X |
| 3,205,877 A | | 9/1965 | Rychlik | 123/44 |
| 3,274,774 A | | 9/1966 | Leone | 60/39.34 |
| 3,581,718 A | | 6/1971 | Petty | 123/44 |
| 3,931,809 A | | 1/1976 | Corte et al. | 123/43 R |
| 3,951,112 A | | 4/1976 | Hunter | 123/8.45 |
| 3,957,021 A | | 5/1976 | Loyd, Jr. | 123/8.11 |
| 4,018,191 A | | 4/1977 | Lloyd | 123/8.45 |
| 4,109,618 A | | 8/1978 | Daniels | 123/43 C |
| 4,134,382 A | | 1/1979 | Southard | 123/243 |
| 4,235,217 A | | 11/1980 | Cox | 123/232 |
| 4,353,337 A | | 10/1982 | Rosaen | 123/243 |
| 4,401,062 A | | 8/1983 | Dean | 123/44 E |
| 4,413,486 A | | 11/1983 | Irwin | 60/39.63 |
| 4,421,073 A | * | 12/1983 | Arregui et al. | 123/43 R |
| 4,530,316 A | * | 7/1985 | Morrison | 123/44 R |
| 4,531,481 A | * | 7/1985 | Haynes | 123/44 R |
| 4,561,836 A | | 12/1985 | Wankel | 418/183 |
| 4,932,850 A | | 6/1990 | Valavaara | 418/171 |
| 5,066,207 A | | 11/1991 | Valavaara | 418/171 |
| 5,181,490 A | | 1/1993 | Ruzic | 123/243 |
| 5,372,107 A | | 12/1994 | Smythe | 123/244 |
| 5,399,078 A | | 3/1995 | Kuramasu | 418/61.2 |
| 5,486,223 A | | 1/1996 | Carden | 75/244 |
| 5,658,138 A | | 8/1997 | Round et al. | 418/150 |
| 5,720,251 A | | 2/1998 | Round et al. | 123/246 |

FOREIGN PATENT DOCUMENTS

| | | |
|---|---|---|
| AU | 466936 | 10/1975 |
| DE | 2 108 733 | 9/1972 |
| EP | 0 394 763 A1 | 10/1990 |
| FR | 2 311 183 | 12/1976 |
| FR | 2 413 550 | 7/1979 |

* cited by examiner

*Primary Examiner*—Hoang Nguyen

(57) ABSTRACT

A rotary device which can be an internal combustion engine, and methods, for receiving fluid input including fuel and air, and generating a fluid discharge. The rotary device includes a stationary outer housing, a rotatable cylinder housing, and a rotatable star-wheel, the star-wheel preferably having a central wheel body, and a plurality of radial arms extending outwardly from the star-wheel body, with pistons connected to the radial arms. The star-wheel, pistons, and cylinder housing are cooperatively designed and configured to rotate substantially in unison within the outer housing whereby the pistons move in reciprocating paths along axes of the cylinders, preferably defining variable angles of about 10 degrees to about 30 degrees, at the piston heads between the longitudinal axes of the cylinders and radians extending from the star-wheel axis of rotation to the head of the respective piston. The housing axis of rotation is preferably displaced from the star-wheel axis of rotation, and the magnitude of displacement between the axes preferably determines compression ratios in the cylinders. The rotary star-wheel preferably defines therein a central body portion and radial arms extending therefrom, the pistons being slidably connected to the radial arms, and received in the cylinders.

46 Claims, 21 Drawing Sheets

PISTON DRIVEN ROTARY ENGINE

CROSS REFERENCE TO RELATED APPLICATIONS

This application claims priority from Provisional Application Ser. No. 60/135,659, filed May 19, 1999.

FIELD OF THE INVENTION

The present invention relates generally to rotary fluid transfer devices such as pumps and internal combustion engines, and particularly rotary internal combustion engines. The invention also relates to methods for generating mechanical work from chemical potential energy using such engines.

BACKGROUND OF THE INVENTION

Internal combustion engines have been conceived of in a variety of designs. A well-known and commonly used internal combustion engine design is a reciprocating piston engine. Reciprocating piston engines, however, have several disadvantages. Reciprocating piston engines tend to be large and heavy, and are of complex construction. Reciprocating piston engines typically comprise a large number of moving parts. Accordingly, reciprocating piston engines typically experience relatively rapid wear and have relatively low rates of utilization of the potential energy in the fuel consumed by such engines. The large weight of reciprocating piston engines typically results in a low power-to-weight ratio. In addition, reciprocating piston engines commonly employ designs, which introduce opposing forces on the drive mechanism during engine operation, decreasing net power and efficiency of the engine, and promoting wear on the drive mechanism.

Another known internal combustion engine design is the rotary engine. The rotary engine was originally devised to provide a simplified means for converting energy in fuel into rotary motion as compared to conventional reciprocating piston engines. In addition, the rotary engine was intended to provide a more efficient engine with fewer moving parts. Such an engine would, in theory, be less susceptible to wear than conventional reciprocating piston engines as a result of the reduction in the number of moving parts. Rotary engines have also been developed in an attempt to obtain increased power-to-weight ratios over those of conventional reciprocating piston engines.

Rotary engines to date have been met with limited success, however, because drawbacks in known rotary engine designs have prevented rotary engines from replacing conventional reciprocating piston engines as a preferred engine design. In some rotary engine designs, the relative speed between adjacent moving and stationary parts is such that effective sealing between such moving and stationary parts during engine operation is not reliably achieved over extended periods of use. Such ineffective sealing may result in decreased engine performance and/or efficiency. For example, some rotary engines utilize stationary chambers that are periodically sealed by a rotating rotor. Because the rotor is often rotating at high speed with respect to the stationary chambers during engine operation, effective sealing by the rotor of gases or fluids in the chambers is not reliably accomplished. Such ineffective sealing of the chambers may allow gases or fluids within the chambers to escape thus reducing engine efficiency and/or performance.

Some rotary engines incorporate protuberances extending from an inner rotating rotor which protuberances remain in contact with a stationary outer housing substantially throughout the rotor revolution to thereby define distinct closed chambers between the rotor and the outer housing for gas or fluid compression and expansion. Rotor rotation typically causes the protuberances to move with respect to the outer housing while the protuberances are in intimate contact with the outer housing. The movement of the protuberances with respect to the outer housing causes frictional energy losses in the engine, thus reducing engine efficiency and performance. In addition, respective protuberances may not form continuous seals with the outer housing throughout the entire rotor revolution, thus breaching respective closed chambers between respective protuberances and the outer housing. Such breaches of the closed chambers may allow gases within the breached chambers to escape, thus reducing the amount of working gases within the combustion chamber, and thereby reducing engine efficiency and performance.

A further problem that exists in known rotary engines is dynamic imbalances introduced to the engine through eccentric rotation of the rotor. Such dynamic imbalances can cause excessive wear on engine parts.

The rotary internal combustion engines proposed to date have failed to sufficiently overcome the problems discussed above.

It is therefore desired to have internal combustion engines which address certain limitations of known rotary and reciprocating piston engines. In addition, it is desired to have internal combustion engines which exploit the inherent rotary engine advantages over conventional reciprocating piston engines.

Specifically, it is an object of the invention to provide engines and pumps having increased efficiency over conventional reciprocating piston engines and pumps.

It is a further object of the invention to provide engines having increased power-to-weight ratios over conventional rotary and reciprocating piston engines.

It is yet another object of the invention to provide engines and pumps which effectively trap and seal gases within one or more chambers.

A further object of the invention is to provide engines and pumps which maintain dynamic internal balances.

It is another object of the invention to provide engines and pumps having significantly reduced frictional losses as compared to known rotary engines.

SUMMARY OF THE INVENTION

The invention is generally directed toward a rotary device for receiving fluid input and generating a fluid discharge therefrom. The rotary device comprises a stationary outer housing, a rotatable cylinder housing, and a rotatable wheel. The stationary outer housing has a circumferential outer wall comprising a first outer surface and a second opposing annular inner surface. The cylinder housing is positioned within the outer housing, and comprises a generally annular outer surface disposed toward and positioned in generally close juxtaposition with at least a portion of the second inner surface of the outer housing. The cylinder housing further includes a central opening therein and a plurality of open cylinders defining passages extending from the central opening generally to the outer surface of the cylinder housing. The cylinder housing further defines a central housing axis of rotation. The rotatable wheel is positioned within the central opening, and defines a wheel axis of rotation displaced from the cylinder housing axis of rotation. At least one inlet aperture receives fluid input into the rotary device and thus into the at least one open cylinder. At least one discharge aperture discharges fluid from the rotary device. A plurality of pistons are connected to the wheel, and extend into respective ones of the open cylinders thereby to define closed fluid processing chambers between the pistons and the inner surface of the outer housing. The rotatable wheel, the pistons, and the rotatable cylinder housing are cooperatively designed and configured to rotate substantially in unison within the stationary outer housing whereby the pistons move in reciprocating paths along longitudinal axes of the cylinders such that sizes of spaces within the cylinders between top sides of the pistons and the tops of the fluid processing chambers alternately increases and decreases, thereby defining variable angles β of about 10 degrees to about 30 degrees, at heads of the pistons between the longitudinal axis of the respective cylinder and a radian extending from the wheel axis of rotation to the head of the respective piston.

In preferred embodiments, the outer housing includes at least one aperture sized and configured to receive an igniter, the aperture being positioned proximate a compression locus of the rotary device.

In preferred embodiments, the rotary device includes at least one igniter disposed in the respective igniter aperture.

In some embodiments, the outer housing includes at least one aperture for intake of fresh air, at least one aperture for intake of fuel, and at least one aperture for exhaust of an ignited fuel/air mixture.

A ring gasket can be disposed at the outer surface of the cylinder housing, optionally surrounding an opening in the outer surface of the cylinder housing, wherein the opening is defined by a respective cylinder. Such ring gasket may be in intimate contact with both the outer surface of the cylinder housing and the inner surface of the outer housing.

In some embodiments, the rotatable wheel includes a central wheel body and at least one radial arm extending outwardly from the central wheel body, the radial arm having a first edge surface extending in a plane parallel to a tangent to the wheel body.

Preferably, the first edge surface includes a slide fixture extending along the length thereof, with the slide fixture being secured to the rotatable wheel at the first edge surface.

Preferably, the rotatable wheel is substantially disc-shaped, the wheel including a first end, a second opposing end, and a third circumferential side there between, the at least one radial arm being defined in the third side, a wheel shaft extending outwardly from the first end, a longitudinal axis of the wheel shaft coinciding with the wheel axis of rotation.

In preferred embodiments, the housing axis of rotation is displaced from the wheel axis of rotation. Typically, the magnitude of displacement between the wheel axis and the housing axis determines the compression ratios in the respective cylinders.

Also in preferred embodiments, respective pistons are connected to respective piston rods, the pistons, the piston rods, and the first edge surfaces, in combination, being configured such that a force applied by a fluid on a top of a respective piston is directed at the first edge surface of the corresponding radial arm at an angle of at least 75 degrees, preferably at least 80 degrees, more preferably at least 85 degrees, and is most preferably perpendicular, with respect to the first edge surface.

The rotary device is in general configured such that an expansive force, associated with a fluid being compressed in a respective fluid processing chamber while the respective piston is in a compression phase of rotation of the cylinder housing, urges the wheel in the same rotational direction as an expansive force associated with an expanding gas trapped within the fluid processing chamber while the respective piston is in an expansion phase of rotation of the cylinder housing.

In some embodiments the rotary device includes a cylinder head in a respective cylinder proximate the outer surface of the cylinder housing. The cylinder head comprises a solid structure having first topside and a second generally opposing bottom side, the first topside being disposed toward the inner surface of the outer housing. The cylinder head preferably includes at least one aperture forming an open passage from the top side to the bottom side, and preferably occupies a cross-sectional area of the chamber.

The invention further comprehends a rotary device wherein the rotary wheel has a wheel axis of rotation defined therein, a central body portion, and a plurality of radial arms extending outwardly from the central body portion, and a plurality of pistons slidably secured to respective ones of the radial arms, and received in respective ones of the cylinders, thereby to define closed fluid processing chambers between the pistons and the inner surface of the outer housing, whereby the pistons move in reciprocating paths along longitudinal axes of the cylinders, the rotatable wheel, the pistons, and the rotatable cylinder housing being cooperatively designed and configured to rotate substantially in unison within the stationary outer housing whereby the pistons move in reciprocating paths along longitudinal axes of the cylinders.

Preferably, the outer housing includes at least one aperture for intake of fresh air into the fluid processing chambers, at least one aperture for intake of fuel into the fluid processing chambers, and at least one aperture for exhaust of ignited fuel/air mixtures from the fluid processing chambers.

Some embodiments include a cylinder head in a respective cylinder, and a ring gasket extending about a perimeter of the cylinder at a top of the cylinder, and interfacing with the inner surface of the outer housing.

The invention yet further comprehends a rotary device for receiving fluid input, and generating a fluid discharge therefrom, wherein the rotatable wheel is positioned within the central opening, the rotatable wheel having a central wheel body and a plurality of radial arms extending outwardly from the central wheel body, and a plurality of pistons connected to respective radial arms for sliding engagement with the radial arms wherein the direction of sliding of a such sliding engagement is represented in a plane parallel to a tangent to the wheel body, and wherein the rotatable cylinder housing, the rotatable wheel, and the pistons rotate in a common rotation about a common central axis within the stationary outer housing thereby to define closed fluid processing chambers between the pistons and the inner surface of the outer housing.

The invention still further contemplates a rotary internal combustion engine, comprising a stationary outer housing having a circumferential outer wall comprising a first outer surface and a second opposing annular inner surface; a rotatable cylinder housing positioned within the outer housing, the cylinder housing comprising a generally annular outer surface disposed toward and positioned in generally close juxtaposition with at least a portion of the second inner surface of the outer housing, the cylinder housing including a central opening therein and a plurality of open cylinders defining passages extending from the central opening generally to the outer surface of the cylinder housing; a rotatable wheel positioned within the central opening; a plurality of pistons connected to the rotatable wheel and extending into respective ones of the open cylinders thereby to define closed combustion chambers between the pistons and the inner surface of the outer housing; a cylinder head in the cylinder housing associated with each the cylinder at or adjacent the outer surface of the cylinder housing, each respective cylinder head comprising solid structure disposed between the inner surface of the outer housing and a portion of the top of the respective piston; a ring gasket disposed at the outer surface of the cylinder housing; and at least one gas passage associated with each cylinder effective to provide sufficient freedom and distribution of fluid flow through the at least one passage from the respective underlying combustion chambers to locations proximate the inner surface of the outer housing at the respective cylinders such that the power generated in the combustion chambers is generally unaffected by fluid flow through the at least one gas passage.

In preferred embodiments, the rotatable inner housing, the wheel, the piston, and the porous head rotate substantially in unison within the stationary outer housing whereby the pistons move in reciprocating paths along longitudinal axes of the cylinders such that spaces within the cylinders between top ends of the pistons and the tops of the combustion chambers alternately increase and decrease.

In some embodiments, the wheel includes a central body and a plurality of radial arms extending outwardly from the wheel body, the radial arms comprising first edge surfaces extending in planes parallel to tangents to the wheel body.

In some embodiments, the first edge surface includes a slide fixture extending along the length of the respective first edge surface, the slide fixtures being secured to the respective first edge surfaces.

In preferred embodiments, the wheel is substantially disc-shaped, and defines a wheel axis of rotation, the wheel including a first end, a second opposing end, and a third circumferential side therebetween, the at least one radial arm being defined in the third side, a first shaft extending outwardly from the first end, a longitudinal axis of the first shaft coinciding with the wheel axis of rotation.

In preferred embodiments, the cylinder housing defines a housing axis of rotation, displaced from the wheel axis of rotation, and wherein the magnitude of the displacement between the wheel axis and the housing axis determines the compression ratios in the respective cylinders.

In preferred embodiments, the pistons are connected to respective piston rods, and the piston rods are connected to the first edge surface of the radial arm, and the pistons, the piston rods, and the first edge surface are, in combination, configured such that a force applied by combusting fuel on a top of a respective such piston in the combustion chamber, is directed at the first edge surface of the corresponding radial arm at an angle of at least 75 degrees, preferably a perpendicular angle, with respect to the first edge surface.

In preferred embodiments, the rotary device is configured such that an expansive force, associated with intake gases being compressed in a respective combustion chamber while the respective piston is in a compression phase of rotation of the cylinder housing, urges the wheel in the same rotational direction as an expansive force associated with expanding gases of combustion trapped within the combustion chamber while the piston is in an expansion phase of rotation of the cylinder housing.

In some embodiments, the ring gasket substantially surrounds an opening in the outer surface of the cylinder housing and the opening is defined at least in part by a respective cylinder.

The invention also comprehends a method of converting chemical potential energy in a fuel into rotational motion in a rotary device including a stationary outer housing having a circumferential outer wall comprising a first outer surface and a second opposing annular inner surface. The stationary housing includes at least one aperture extending through the outer wall to thereby provide a passage from the first outer surface to the second inner surface. The rotary device further includes a rotatable cylinder housing comprising an outer surface disposed toward the second inner surface of the outer housing, the cylinder housing including a central opening and a plurality of open cylinders defining passages from the central opening to the outer surface of the cylinder housing, the rotatable cylinder housing defining a housing axis of rotation. The rotary device still further includes a rotatable wheel positioned within the central opening, the rotatable wheel defining a wheel axis of rotation of the rotatable wheel, displaced from the housing axis of rotation, and a plurality of pistons connected to the rotatable wheel and extending into respective ones of the open cylinders thereby to define closed combustion chambers between the pistons and the inner surface of the outer housing. The method comprises providing at least initial rotational motion to the cylinder housing, whereby the rotatable wheel and the pistons rotate in unison with the cylinder housing; providing combustion air and fuel to a respective combustion chamber so as to provide a fuel-air mixture therein; igniting the fuel/air mixture in the combustion chamber; enabling the ignited fuel/air mixture to expand within the combustion chamber by enabling the wheel to rotate, whereby the displacement of the wheel axis and the housing axis from each other causes the piston to move longitudinally in the respective combustion chamber, away from the inner surface of the outer housing; and exhausting the combustion gases from the combustion chamber.

Figure 1:
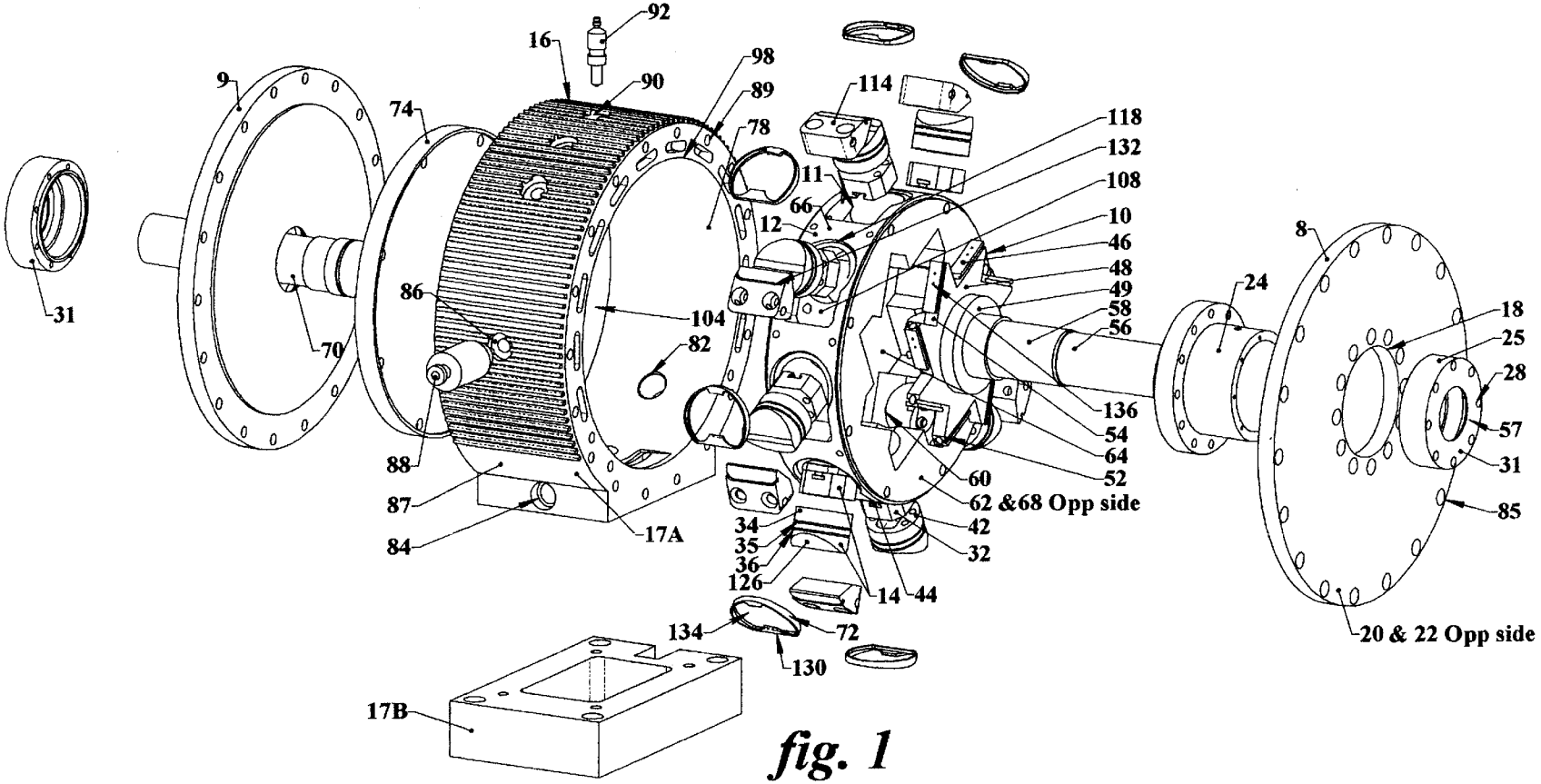
FIG. 1 shows a pictorial exploded view representation of a first embodiment of piston-driven rotary engines of the invention.

It is to be understood that the invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENT

Referring now by characters of reference to the drawings, FIG. 1 is an exploded view of selected elements of piston-driven rotary engine 6. In general, engine 6 includes a stationary outer housing 16, which receives a rotating cylinder housing 12 which rotates in cooperation with a rotary star wheel 10. Offset plate 8 provides general closure of a first end of outer housing 16. Closure plate 9 (FIG. 8) provides general closure of the second opposing end of outer housing 16. A plurality of piston assemblies 14 are mounted on star wheel 10 and received in cylinders 11 defined in cylinder housing 12, so as to rotate with cylinder housing 12 and star wheel 10. Combustion of fuel/air mixtures in cylinders 11, in the cylinder housing, powers the driving of piston assemblies 14 thereby to turn star wheel 10 and rotary shaft 56 from whence useful power can be derived.

Figure 8:
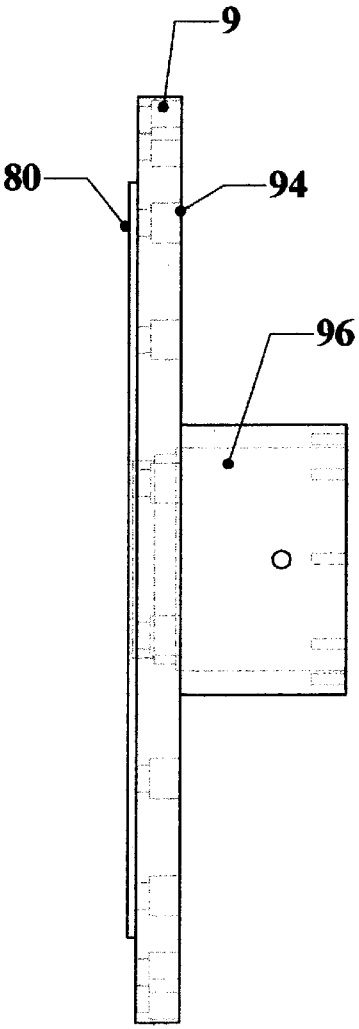
FIG. 8 shows a pictorial view of an outer housing used in the embodiment of FIG. 1.
Figure 8:
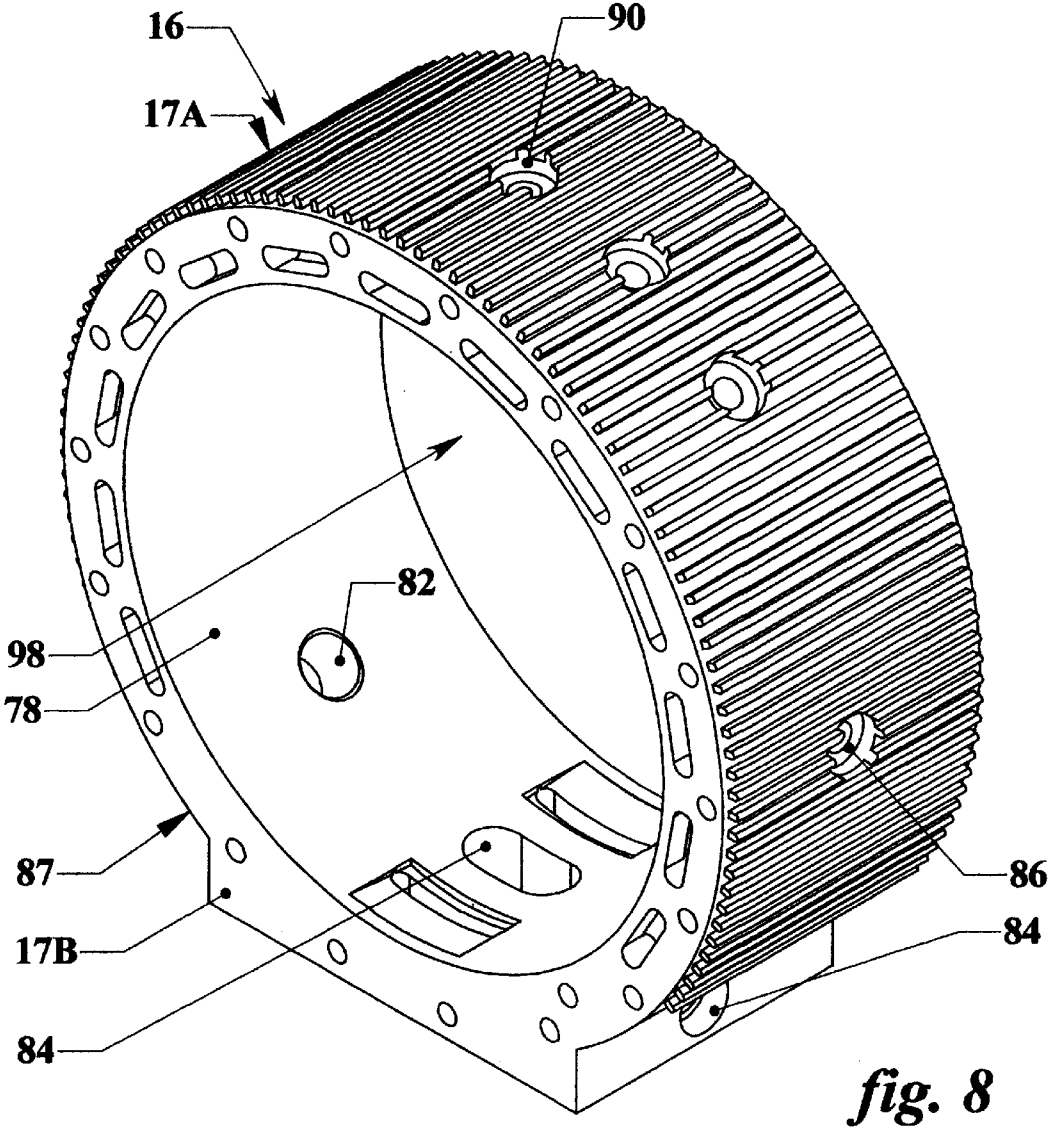

Outer housing 16 is illustrated in FIGS. 1 and 8. As illustrated therein, the outer housing comprises an annular housing body 17A mounted on or integral with a support base 17B. Outer housing 16 serves as a structural body defining a structure to which other elements of engine 6 can be directly or indirectly mounted. Outer housing 16 also shields other interior elements of the engine from the outside environment as well as protecting e.g. an operator or the environment from operating conditions inside the engine.

Figure 10:
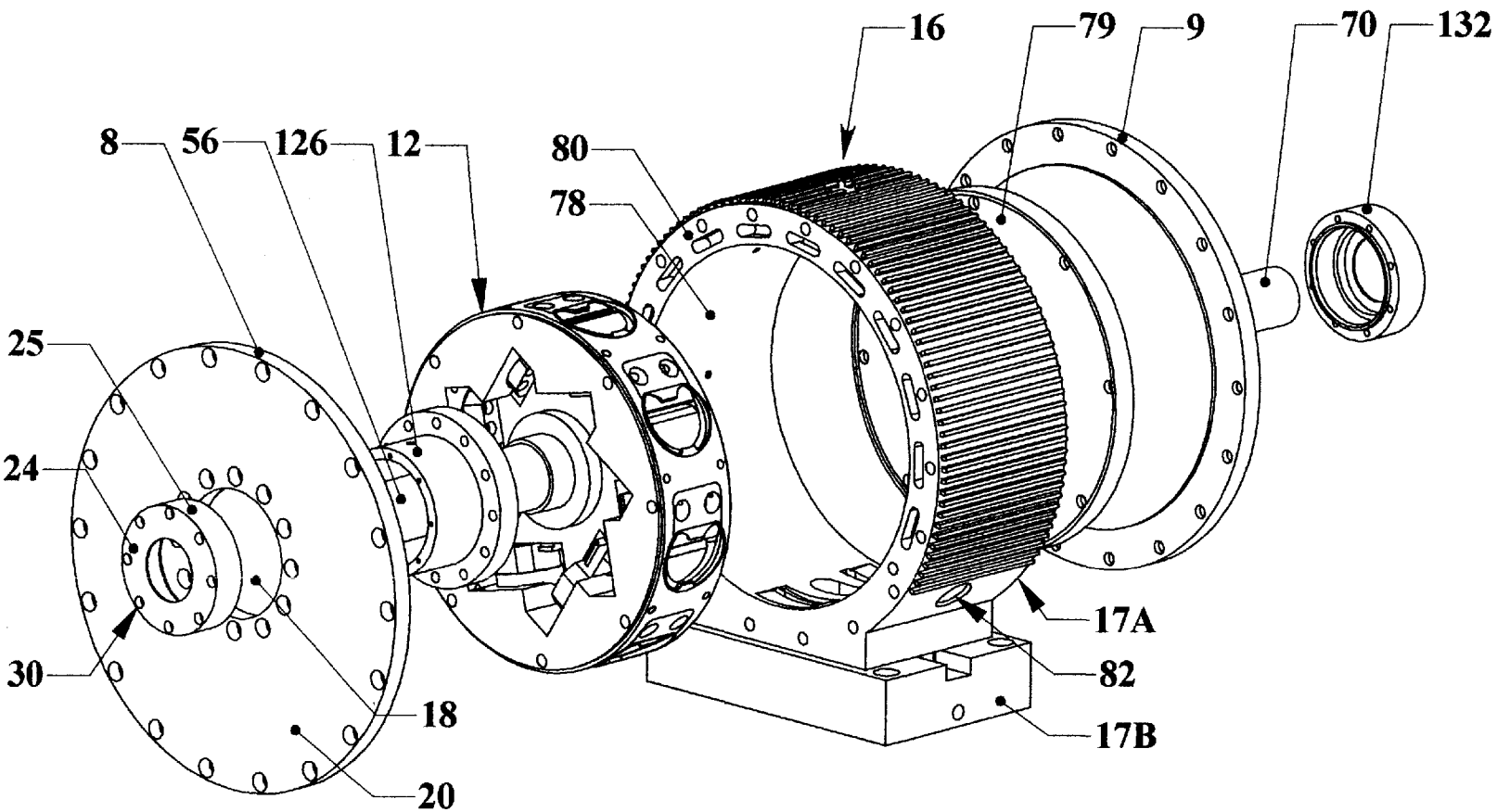
FIG. 10 shows a pictorial left-side exploded view representation of a second embodiment of piston-driven rotary engines of the invention.

Offset plate 8 comprises a central aperture 18 which forms a corresponding passage between outer surface 20 of the offset plate and inner surface 22 of the offset plate. Central axis "A1" (FIG. 4) extends through aperture 18 and generally defines the center of rotation of offset plate 8. Hub 24 has an outer surface, and a length extending a distance "d" (FIGS. 3, 4, and 10) perpendicularly from outer surface 20 of the offset plate. Hub 24 extends through central aperture 18 and outwardly from outer surface 20, encompassing, and being in alignment with, central axis "Al." Hub 24 can be integral with offset plate 8 (FIG. 3) or can be a separate element joined to offset plate 8 (FIG. 10). Hub 24 is preferably positioned such that the inner surface of the hub is in alignment with circumferential edges of aperture 18 at inner surface 22 (FIG. 10) so as to form a continuous channel 26 (FIG. 3) extending from offset plate inner surface 22 to an outer end surface 30 of hub 24 disposed outwardly of outer surface 20 of plate 8. Central passage 26 is generally open and preferably defines, in combination with central passage 57 of bearing 28 housed therein, a constant cross-section, in size and configuration, along a continuous path extending from inner surface 22 of the offset plate to outer end surface 30 of hub 24, optionally including a first bearing retainer 31. The circumference of the outer surface 25 of hub 24 and a corresponding circumference of the inner surface of the passage defined by aperture 18 are preferably equal or nearly equal, and aligned with each other, so as to provide for a close-tolerance fit of the outer surface of the hub into aperture 18. Central passage 26 in the hub has an open cross-section, which is generally constant in both size and configuration along the entirety of the length of the passage.

One or more ring bearings 28 are mounted, e.g. by friction fit, in passage 26 such that the axes of the bearings are aligned with central axis "A1."

Each piston assembly 14 (FIG. 5) includes a piston 34, a piston rod 32 mounted to the piston, and piston rings 36. Piston 34 is preferably substantially cylindrical, and is preferably metal such as steel, aluminum, titanium, ceramics, BORALYN®, or other material known or otherwise suitable for use in pistons. The material composite used to fabricate piston 34 must have, for example and without limitation, sufficient strength, rigidity, durability, and fatigue life at engine operating conditions to support activity of the piston.

BORALYN® represents a family of ceramic-modified metal compositions comprising primarily aluminum as the base material, boron derivatives as ceramic additive moieties, and other suitable alloying additives, wherein the relationship of aluminum and boron to each other is about 80 weight percent to about 90 weight percent aluminum and correspondingly about 20 weight percent to about 10 weight percent boron. A more detailed description of such boron modified aluminum matrix compositions is provided in U.S. Pat. No. 5,486,223, herein incorporated by reference in its entirety.

Piston 34 may be hollow or solid, or any configuration, which can be considered a combination of hollow and solid, along a top-to-bottom length of the piston. Hollow pistons are well known in the combustion engine art, for their benefits of heat dissipation and for preferably mass, and inertia benefits, as compared to solid pistons, and so are preferred.

Figure 2:
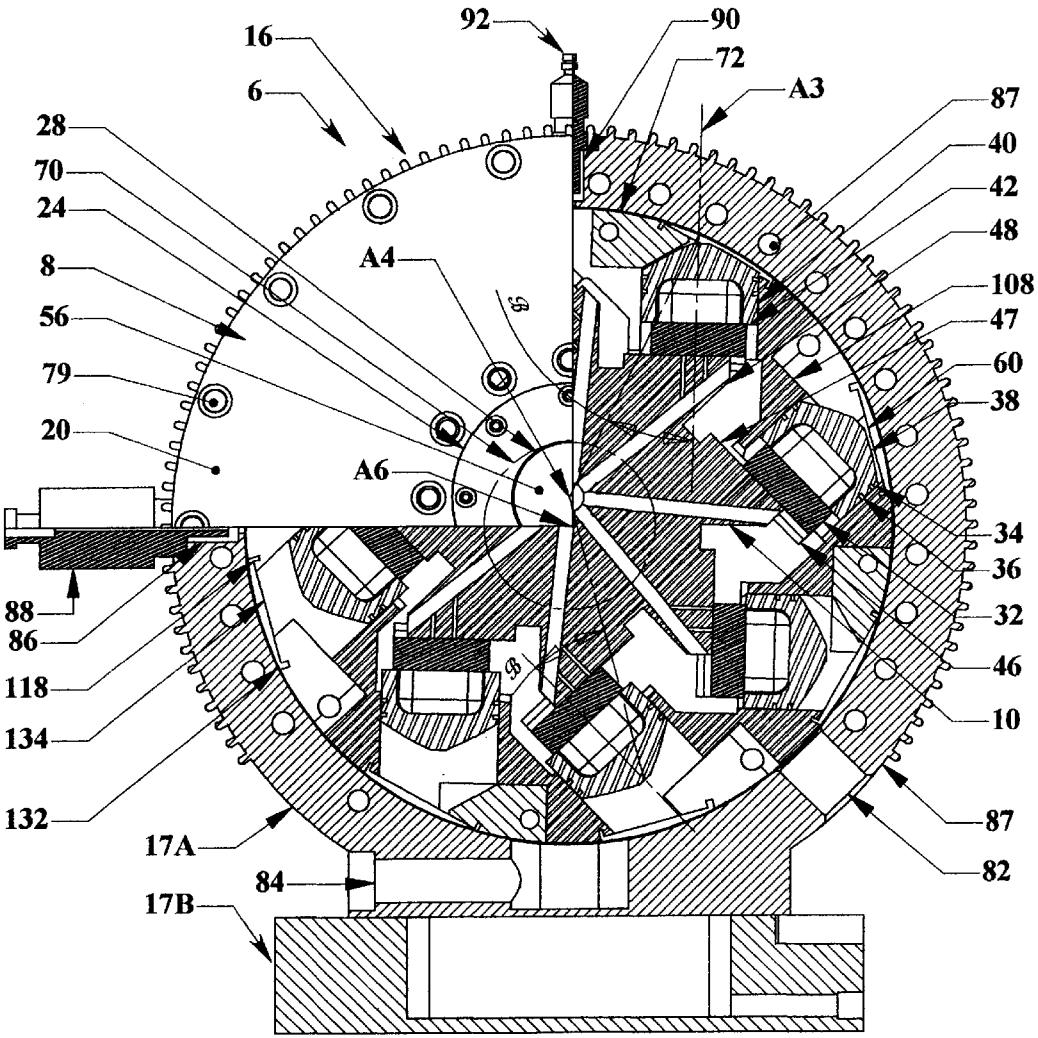
FIG. 2 is a partially cut-away end view of a piston-driven rotary engine of the invention, similar to that of FIG. 1.

Ring seats or grooves 35 extend about the circumference of sidewall 40 of the piston. Piston rings 36 are received in the ring seats or grooves around at least a portion, preferably substantially the entirety, of the outer perimeter of the piston. Typically, a portion of the thickness, inside diameter to outside diameter, of a ring 36 extends outwardly of the outer surface of the respective side wall 40 when the ring is received in a groove 35, including when the piston/ring assembly is inserted into a cylinder 11 (FIG. 2). Piston rings 36 (FIG. 5) are preferably non-rigid, flexible, annular, spring-like, and tolerant of combustion chamber operating conditions. The piston rings are preferably sufficiently resilient to deform under pressure and to subsequently return to approximately their previous shape when released from deflecting force. Typical materials for rings 36 are those materials known for use in conventional piston rings, for example and without limitation 4130-chrome moly steel.

Figure 5B:
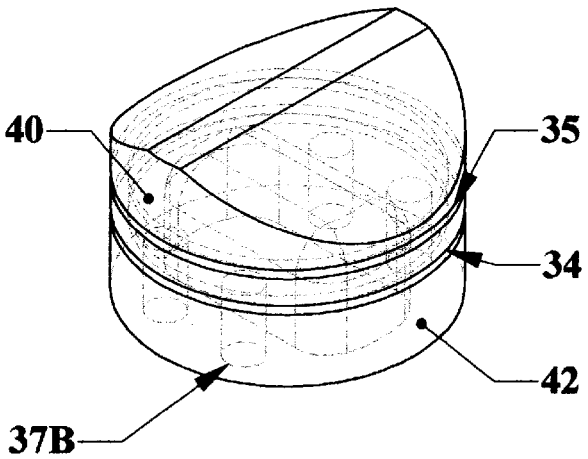
FIG. 5B shows a bottom pictorial view of the piston of FIG. 5, without rings in the ring grooves in the piston sidewall.
Figure 5:
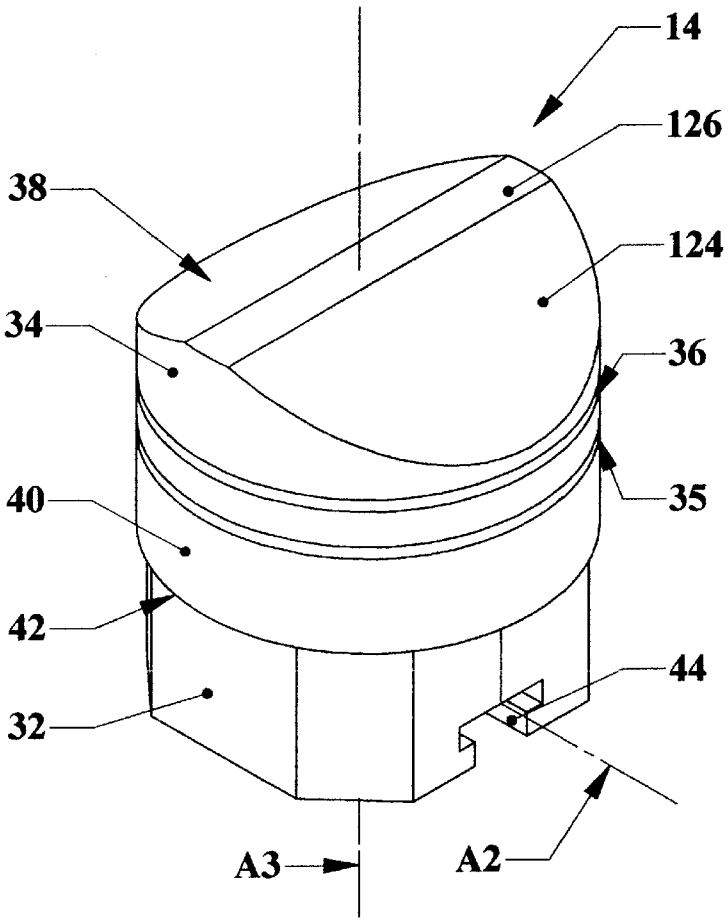
FIG. 5 shows a pictorial view of a piston assembly used in the embodiment of FIG. 1.
Figure 5A:
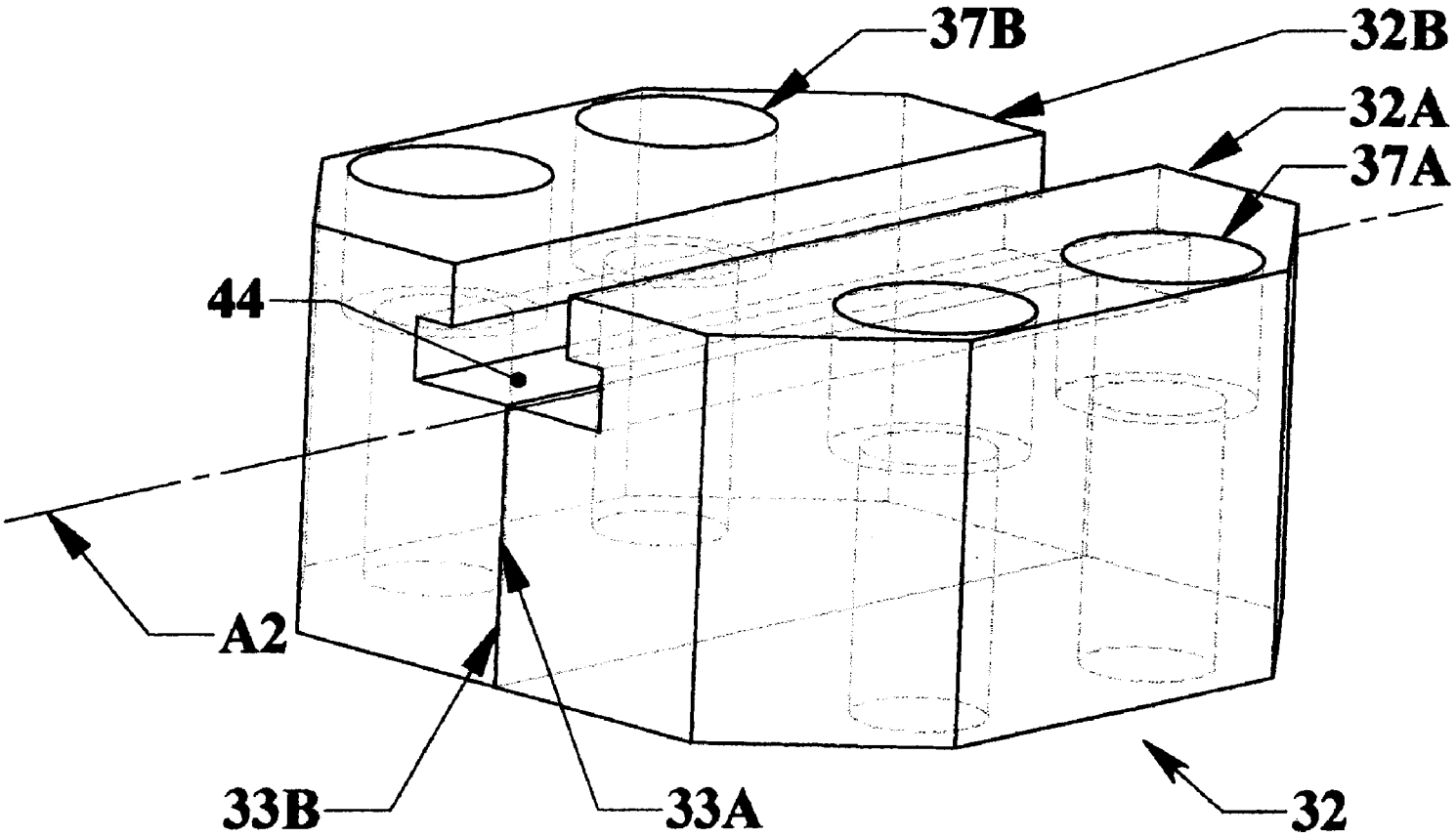
FIG. 5A shows a bottom pictorial view of a piston rod used in the embodiment of FIG. 1.

As illustrated in FIG. 5A, piston rod 32 comprises, for ease of fabrication, left and right rod elements 32A, 32B. Left rod element 32A abuts right rod element 32B at respective central faces 33A, 33B which are, in the illustrated embodiment, positioned at a midpoint line of slide channel 44. The abutting faces can be spaced from the midpoint line, and can alternatively be spaced from each other. Further, rod 32 can be fabricated as a single unitary article.

Piston rod 32 extends from inner end 42 (FIGS. 2, 5, 5B) of piston 34 toward star wheel 10 (FIG. 1). The left and right rod elements, and thus rod 32, can be attached to inner end 42 of piston 34 e.g. by bolts 39 (FIG. 3) inserted through mounting holes 37A (FIG. 5A) in the rod elements, and into mounting holes 37B (FIG. 5B) in inner end 42 (FIG. 5B) of the piston. In alternative embodiments wherein the piston rod is attached to the piston inside a hollow piston cavity, the piston rod extends outwardly from inner end 42 of the piston. Piston rod 32 is preferably fabricated from the same material as piston 34 (FIG. 5B) and can be made from any suitable material having sufficient e.g. strength, rigidity, durability, and fatigue life at engine operating conditions to support activity of the piston on wheel 10.

In the illustrated embodiments, slide channel 44 is defined in the combination of rod elements 32A, 32B (FIG. 5A), and preferably comprises a continuous open-sided passage along the bottom inner end of the piston rod. Slide channel 44 is preferably oriented in the piston rod 32 such that a longitudinal axis "A2" of the passage is perpendicular to the longitudinal axis "A3" (FIG. 2) of the respective piston. The distal end 42 of the respective piston rod 32, corresponding to slide channel 44 (FIG. 5A), preferably opposes the end of the piston which is disposed in the combustion chamber 60 (FIG. 7) of the respective cylinder 11.

Star wheel 10 (FIG. 6) provides structure onto which piston assemblies 14 are preferably mounted. In a preferred embodiment, star wheel 10 is generally disk-shaped, preferably having a plurality of radial arms 48 radiating outwardly, in a common plane, from a hub 49. Radial arms 48 are preferably secured to hub 49, and more preferably are integral with hub 49. Preferably, the outer ends 52 of respective radial arms 48 (FIG. 6) are all equidistant from central axis "A4" of star wheel 10. In addition, radial arms 48 are also preferably all equally sized and configured so that the center of rotational gravity of wheel 10 is coincident with central axis "A4." The radial arms are thus preferably equally spaced from each other around the circumference of wheel 10, and are preferably equal in number to the number of piston assemblies 14 in a given engine 6 of the invention. Hub 49 and fingers 48 are preferably made from the same material, each as the other, which material can be e.g. steel, and more preferably aluminum, titanium, ceramics, BORALYN® or other relatively lighter weight material compatible with operating conditions of the engine.

Figure 6:
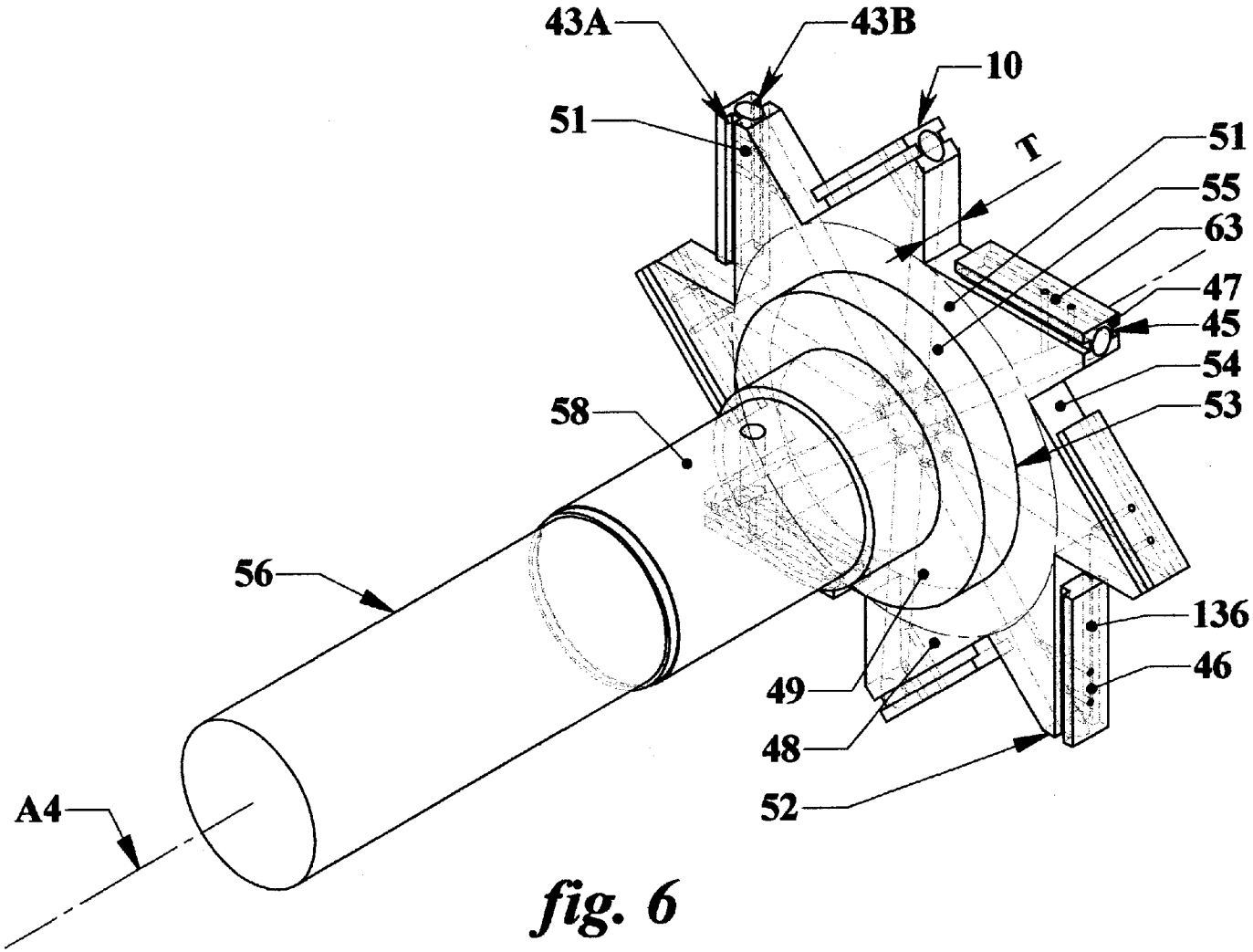
FIG. 6 shows a pictorial view of a star wheel used in the embodiment of FIG. 1

In the embodiment illustrated in FIGS. 1 and 6, wheel 10 comprises a central body portion 51 which defines annular interior opening 53, receiving the outer perimeter 55 of hub 49. The outer perimeter of central body portion 51 is defined short of outward extensions of radial arms 48. Thus, the outer perimeter of central body portion 51 is shown generally by a dashed outline extending about the circumference of star wheel 10 at the base of radial arms 48. Radial arms 48 thus extend outwardly from central body portion 51, though preferably being integral with, central body portion 51.

Each radial arm 48 has an outwardly-facing surface 54, underlying a slide fixture 46, which is aligned with the opposing disk-shaped facing surfaces 43A, 43B (FIG. 3) defined by radial arms 48 and central body portion 51. Outwardly-facing surface 54 is also contained in an imaginary plane parallel to and displaced from, central axis "A4." Each slide fixture 46 (FIG. 6) includes a support web 45 mounted to the respective radial arm 48 at surface 54, and a slide flange 47 mounted to the web. Support web 45 and flange 47 are both oriented generally along the displaced plane. Each such radial arm 48 is oriented in a separate and distinct such displaced plane.

Piston assemblies 14 (FIG. 5) are preferably slidably mounted to respective radial arms 48 of star wheel 10 by engaging respective slide channels 44 of piston rods 32 onto respective flanges 47 on radial arms 48 of star wheel 10. Slide channels 44 and slide fixtures 46 are mutually sized and configured such that the respective slide fixtures are inserted into channels 44 whereby, when channels 44 are engaged with fixtures 46, the respective piston assemblies 14 are secured to the respective radial arms and can slide along the lengths of the respective slide fixtures 46.

Slide fixtures 46 are preferably secured to respective radial arms 48 of star wheel 10, and more preferably are integral with respective radial arms 48 of star wheel 10. Slide fixtures 46 can be, for example and without limitation, welded to respective outwardly-facing surfaces 54 of radial arms 48, whereby slide fixtures 46 are generally trans-sected by a plane extending along the mid-point of the thickness "T" of star wheel 10 and through axis "A4." Because piston assemblies 14 preferably slide along slide fixtures 46, the piston assemblies preferably slide along the respective displaced plane of the respective radial arm 48.

Radial arms 48 are preferably shaped such that respective outwardly-facing surfaces 54 form substantially flat surfaces to which slide fixtures 46 are secured. The flat surfaces 54 preferably extend in the same directions as the above mentioned displaced planes and thus extend parallel to tangents to hub 49 at closest approach of extension of respective such surfaces to hub 49. Additionally, imaginary lines passing perpendicularly through respective outwardly-facing surfaces 54 are also preferably oriented parallel to tangents to hub 49 at closest approach of extensions of such surfaces to hub 49.

Flat surfaces 54 correspond to outwardly-facing edges of the respective arms 48. Slide flanges 47 preferably define acute angles of at least 75 degrees with respect to axes "A3" (FIG. 5) of the respective piston heads, whereby force exerted by a piston 34 is transmitted to the respective slide fixture at an effective contact angle of at least 75 degrees, thus to provide for efficient force transfer from the piston to the respective arm 48. The most preferred angle is 90 degrees (perpendicular) with 80 degrees, 85 degrees, and all other angles between 75 degrees and 90 degrees being contemplated.

Outwardly-facing surfaces 54 are oriented such that the imaginary tangent lines are in planes parallel to the plane extending along the mid-point of the thickness "T," providing for displaced-angle radial motion of the piston assemblies.

As used herein, "displaced angle radial motion" refers to the nominal angle β (FIG. 2) between piston axis "A3" at piston head 38 and a radian through the center of rotation at axis "A4" of star wheel 10. While the magnitude of angle β varies as the piston traverses its circular path, the magnitude of angle β generally operates within a range of about 10 degrees to about 30 degrees and all other angles therebetween, preferably about 20 degrees to about 30 degrees, more preferably about 25 degrees to about 30 degrees. The particular magnitude of angle β, of course, depends somewhat on the length of the stroke of the piston, as controlled by distance "D1." The longer the stroke, the greater the variation in angle β as the piston traverses its path.

Angle β (FIG. 2) also is affected by the distance of closest approaches of axes "A3" and "A4," which provides the moment arm for the respective piston 34 to drive rotation of star wheel 10, and accordingly shaft 56. Namely, as the piston traverses its circular path, the downward force exerted by the piston on the underlying slide fixture is at all times directed in a line whose closest approach to axis "A4" of the star wheel is substantially displaced from axis "A4," thereby providing the operating lever arm between axis "A3" of the piston and axis "A4" of star wheel shaft 56.

A piston assembly 14 can be secured to star wheel 10 through a variety of means. For example, instead of slide fixtures 46 and channels 44, the piston assembly can be secured to the star wheel via one or more wrist pins (not shown) in rod 32, which wrist pin slides along a slot (not shown) extending along the length of web 45, or finger 48 in the absence of web 45.

Another exemplary method of securing the piston assemblies 14 (FIG. 5) to star wheel 10 is to use rolling devices (not shown) which are preferably secured to respective piston rods 32, and are preferably confined to travel along outer surfaces 63 (FIG. 6) of the respective flanges 47. In a preferred embodiment of such a securement, the rolling devices travel along the lengths of respective flanges 47, but are unable to disengage from respective flanges 47. Furthermore, the rolling devices are preferably secured to respective piston rods 32 (FIG. 5A).

Figure 3:
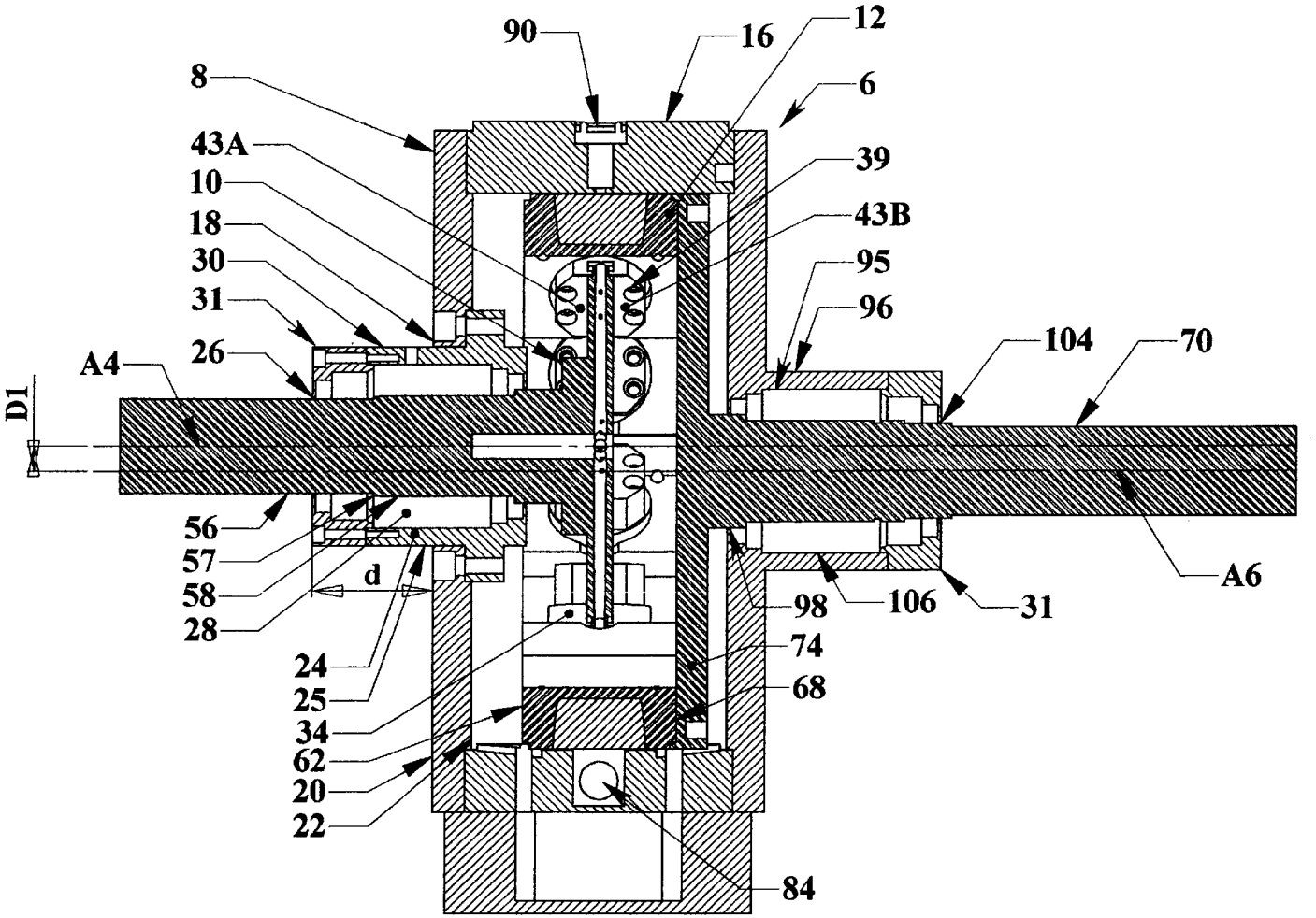
FIG. 3 is a cross-section of a side view of the piston-driven rotary engine of FIG. 2.
Figure 4:
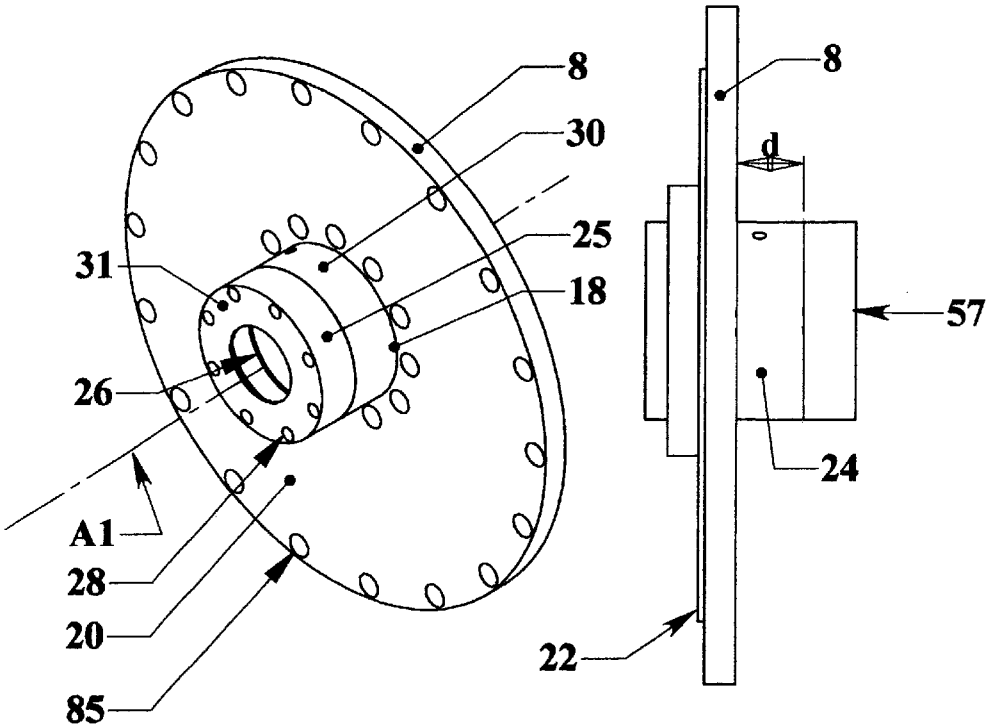
FIG. 4 shows a pictorial view of an offset plate used in piston-driven rotary engines of the invention.

Star wheel shaft 56 (FIG. 6) extends from hub 49, optionally from star wheel 10 in the absence of hub 49, at a perpendicular to wheel 10, preferably extending centrally from wheel 10 or hub 49 such that the central axis of rotation of shaft 56 is coincident with the central axis of rotation "A4" of star wheel 10. Shaft 56 is preferably dimensioned to be inserted, with a close fit, through central opening 57 in bearing 28 (FIG. 3). Preferably, that portion 58 of shaft 56 which enters opening 57 is substantially the same diameter as the diameter of opening 57, whereby shaft 56 can be pressed by a friction fit into opening 57, thus to mount shaft 56, and correspondingly star wheel 10, to bearing 28. Shaft 56 need not have a constant cross-section along the length thereof. In preferred embodiments, at least that portion 58 of shaft 56 which interfaces with bearing 28 has a diameter or other cross-section corresponding to the inside dimension of bearing 28 (opening 57). Shaft 56 is preferably, but not necessarily, fabricated from the same material as star wheel 10, and can be, for example, steel, aluminum, BORALYN®, titanium, or other suitable structural material.

Especially preferred material for star wheel 10, including shaft 56, is titanium or titanium alloy. Another and specific preferred material for star wheel 10 and/or shaft 56 is 4130 stainless steel.

In preferred embodiments, shaft 56, and the star wheel, including fingers 48, optionally slide fixtures 46, are all machined from a single piece of material such as, for example and without limitation, a casting.

When engine 6 is assembled, star wheel 10 and piston assemblies 14 are positioned within rotatable cylinder housing 12. Cylinder housing 12 comprises a central housing body 61, and opposing plates defining opposing end walls 62, 68 secured to body 61 e.g. by bolts (not shown).

Cylinder housing 12 (FIG. 7) has a generally cylindrical outer surface 66, and is preferably sized and configured to receive star wheel 10 through a central opening 59 in end wall 62. In preferred embodiments, star wheel 10 is received through central opening 59 and thence into central opening 64 in the cylinder housing body. Cylinder housing 12 can be fabricated from steel, aluminum, titanium, BORALYN®, or other suitable material as suggested for other elements exposed to the heat and other operating conditions of the internal combustion process.

Cylinder housing 12 (FIG. 1) includes the discrete cylinders 11, which receive respective piston assemblies 14. Cylinders 11 are individual and distinct continuous passages extending through housing 12 from lower ends thereof at central opening 64 to upper ends at or disposed toward outer surface 66. In preferred embodiments, as illustrated in the drawings, cylinders 11 are arranged in the space defined between two generally parallel planes, in general represented by end walls 62 and 68, and extending about the circumference of the cylinder housing as defined by outer surface 66, forming distinct continuous passages between opening 64 and outer surface 66. Cylinders 11 are preferably equally spaced about the circumference of cylinder housing 12. The number of cylinders 11 preferably equals the number of piston assemblies 14 and radial arms 48 utilized in a particular engine 6. In an assembled engine, the central axes "A5" (FIG. 7) of the respective cylinders reside in an additional set of imaginary planes oriented perpendicular to and displaced from central axis "A4" (FIG. 6), generally perpendicular to the first set of displaced planes extending along radial arms 48, and perpendicular to end walls 62, 68 (FIG. 1).

In the embodiments illustrated, star wheel 10 (FIG. 1) is supported by shaft 56 at load bearing 28. Thus, shaft 56 and bearing 28 are suitably designed to bear such load. Accordingly, in an engine 6 wherein cylinder housing body 61 has a maximum outer diameter at surface 66 of e.g. 11 inches, shaft 56 has a preferred outer diameter at bearing 28 of e.g. about 2 inches.

Figure 7:
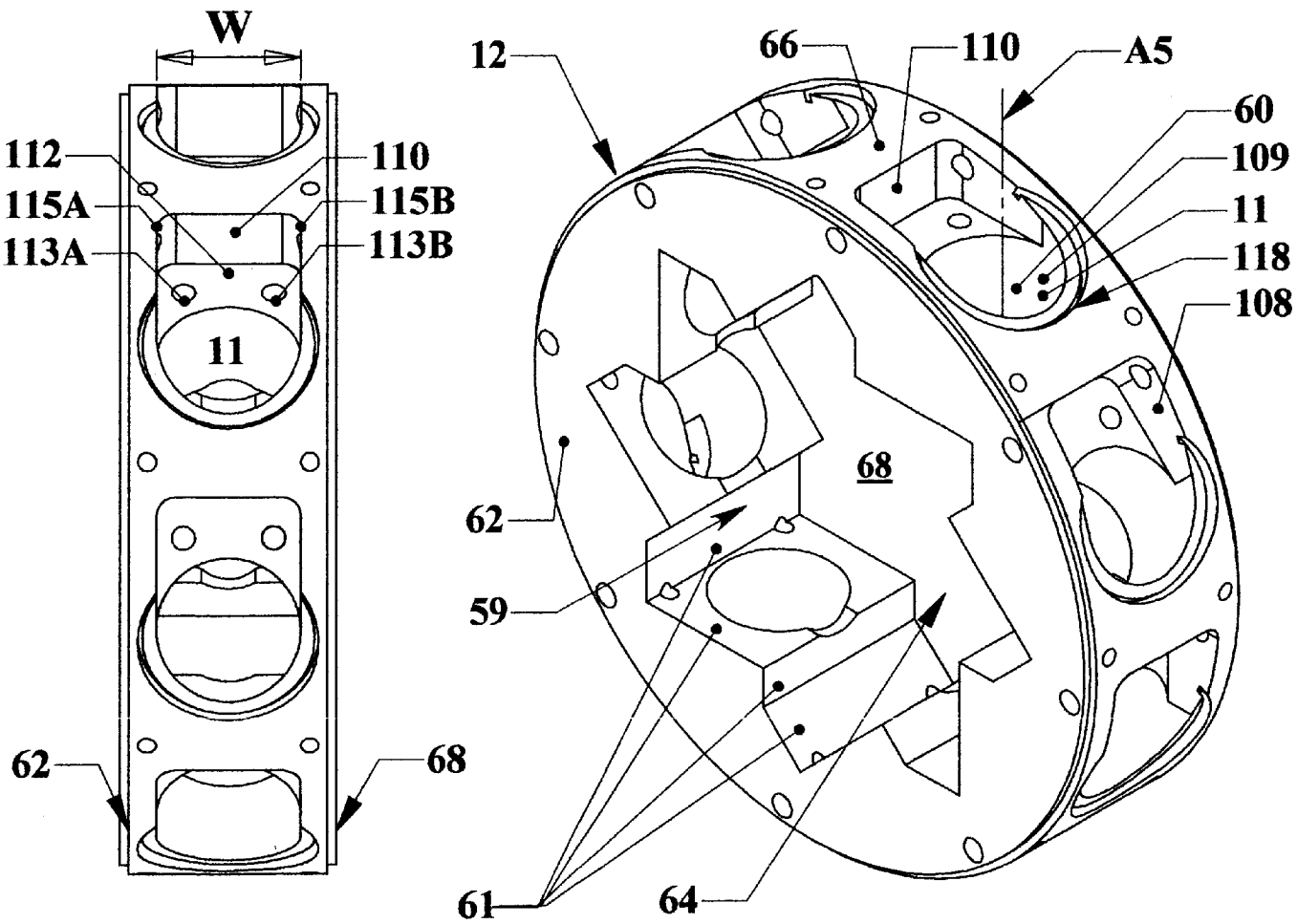
FIG. 7 shows a pictorial view of a second embodiment of a cylinder housing assembly used in engines of the invention.
Figure 9:
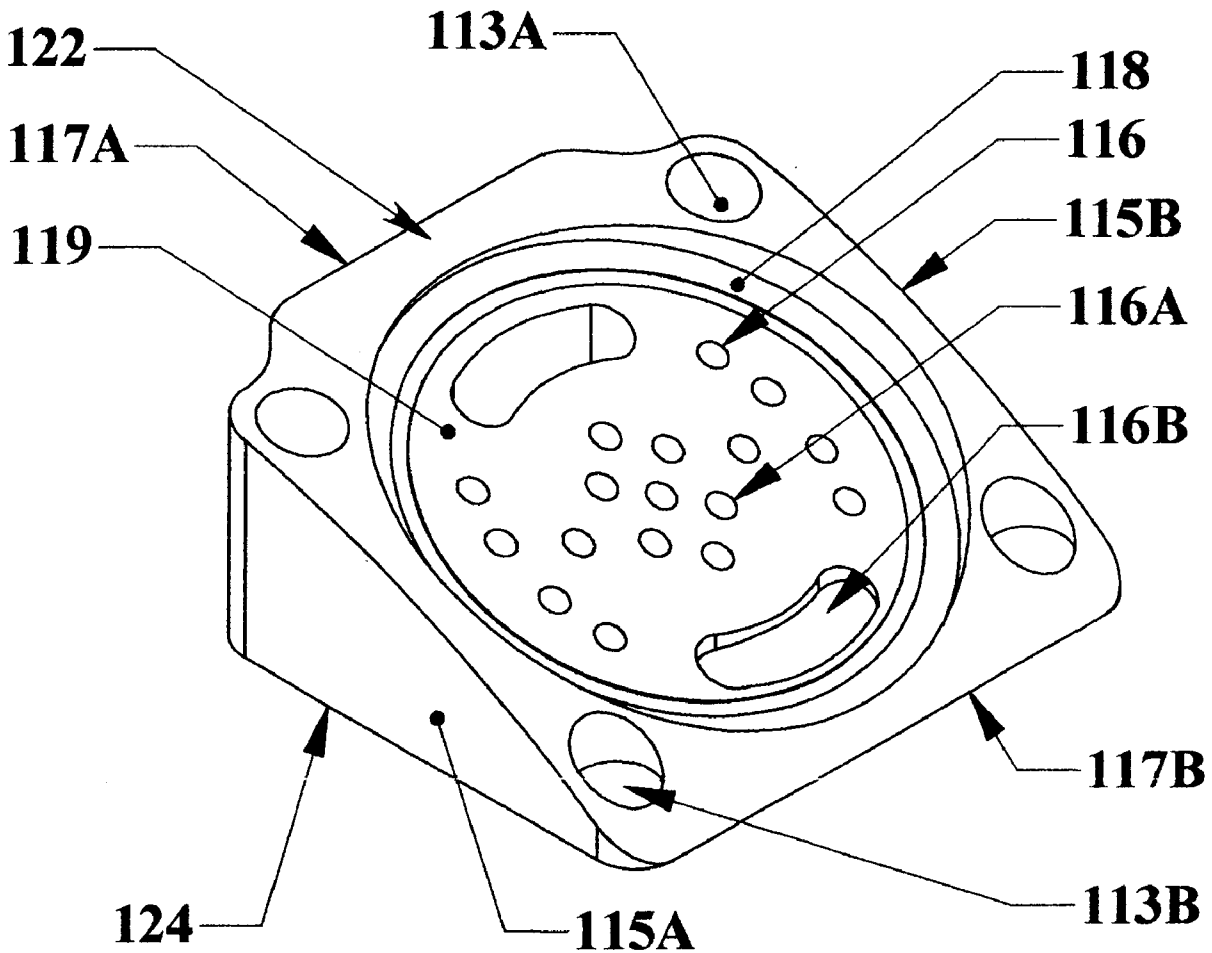
FIG. 9 shows a cylinder head for use in combination with the cylinder housing of FIG. 7.

In a second embodiment of cylinder housing assemblage illustrated at, among other places, FIGS. 7 and 9, outer surface 66 of the cylinder housing includes recesses 108 at and adjacent respective openings formed by cylinders 11 in the outer surface. Such recesses 108 are substantially wedge-shaped, and are located inwardly of the maximum outer diameter defined by outer surface 66, and are generally confined between end walls 62, 68. A respective recess 108 can include, for example, a radially extending first wall 110 extending substantially along width "W" of housing body 61 between end walls 62, 68, and extending a distance inwardly from the maximum outer diameter, optionally parallel to side wall 109 (FIG. 7) of the respective cylinder 11; and a second wall 112 extending at a perpendicular angle from the first wall and especially perpendicular to central axis "A5" of the cylinder.

The second walls 112 of respective recesses 108 are illustrated in FIG. 7 as planar and forming openings at intersections with respective cylinders 11. The recesses are preferably configured such that the second walls are substantially perpendicular to the axis of the respective cylinder 11. First and second walls 110 and 112 can define a wide range of wall configurations so long as walls 110 and 112 are designed and configured for cooperative assembly into the respective recesses of cylinder head 114, and corresponding ring gaskets 72 described in more detail following.

In the assembled engine embodiments represented in FIGS. 1–8, recess 108 defines a void space in cylinder housing 12, between inner surface 78 of outer housing 16 and the top of the respective piston, at the end of travel of the piston toward inner surface 78, as well as that space defined outwardly of cylinder side wall 109 and above second wall 112. Even without the space defined outwardly of sidewall 109, a certain void space exists in the cylinder above the piston, assuming a symmetric piston head design.

In order to realize compression ratios within conventional ranges for internal combustion engines, the void space outwardly of the cylinder side wall 109 is developed for mounting purposes, and a cylinder head 114 is mounted in the void space as structure which occupies a substantial portion of the otherwise void space. Head 114 establishes a barrier to entry of gases into the space defined outwardly of a projected cylinder sidewall 109, and in the illustrated embodiment substantially occupies such space. The remainder of the void space, defined from imaginary extensions of sidewall 109 inwardly, is substantially occupied by cylinder head 114. By so preventing compressible gases from occupying such void space, a more desirable compression ratio can be achieved.

Cylinder heads 114 are sized and configured to be mounted in cylinder housing 12 at respective recesses 108 e.g. by bolts (not shown) extending through holes 113A (FIG. 9) and into cylinder housing 12 at bolt holes 113B (FIG. 7). A cylinder head 114 (FIG. 9) is thus preferably sized and configured to substantially fill the void space defined by the respective recess 108 and above the top of the piston stroke at the end of piston travel upwardly toward inner surface 78, as described in more detail hereinafter. Cylinder head 114 (FIG. 9) has a top 122, a bottom 124, opposing side walls 115A, 115B, and opposing end walls 117A, 117B.

As illustrated in FIG. 9, the cylinder head is substantially wedge-shaped as defined by sloping top 122, which follows the general outline of inner surface 78 of outer housing 16. The height of the cylinder head tapers downwardly from end 117A to the opposite end 117B such that the height at the first end is greater than the height at the second end. The tapered height defines top 122. When the cylinder head is mounted to cylinder housing body 61 e.g. by the above-mentioned bolts, the so-contoured top of the cylinder head 114 generally follows the contour of inner surface 78 of outer housing 16, while the bottom of the cylinder head 114 is preferably in intimate contact with the respective second wall 112 of recess 108 and generally exhibits a shape complementary to the shape of wall 112, and complementary to the top of the underlying piston 34.

Cylinder head 114, as illustrated in FIG. 9, contains one or more open passages 116 extending from the tapered top 122 to bottom 124. Some of the passages illustrated in FIG. 9 are circular and have constant diameters from top 122 to bottom 124, thus defining substantially cylindrical openings along the full lengths of the respective passages. Passages 116 can have other cross-sections such as, for example and without limitation, oval, oblong, and polygonal such as square, rectangular, pentagonal, hexagonal and the like. Multiple passage cross-section styles and designs can be employed in any given head when desired. For example, head 114 of FIG. 9 shows both circular passages 116A and front and rear arcuate passages 116B. In general, passages 116 are configured to provide for fluid flow between the top and the bottom of the respective cylinder head 114.

Passages 116 in the cylinder head generally form open and unobstructed fluid communication passages for conveying gases between top 122 and bottom 124 of cylinder head 114.

The configuration and distribution of passages 116 are arranged to provide sufficient freedom and distribution of fluid flow through head 114 to and from the respective underlying combustion chamber such that the power generated in the combustion chamber underlying head 114 is generally unaffected by fluid flow limitations through passages 116. Namely, passages 116 are sized and configured such that fluid flow limitations into and out of combustion chambers 60 are more controlled by passage configurations of intake ports 84 and exhaust ports 82 than by passages 116, while providing a desirable degree of "filling" of the void space so as to develop desired control of the compression ratio.

To enable gas flow to and from intake ports 84 and exhaust ports 82, and to propagate fuel ignition, a portion 119 of top 122 of the respective cylinder head 114 is preferably recessed away from inner surface 78, whereby a passage is provided for passing e.g. air from air intake ports 84 to passages 116 and thence to the underlying cylinder, and receiving exhaust gases from the underlying cylinder through passages 116 and passing such exhaust gases thence to exhaust ports 82. In addition or in the alternative, especially a central portion (not shown) of bottom 124 of cylinder head 114 can be recessed upwardly from a plane defined by second wall 112, especially in cooperation with a corresponding upwardly disposed configuration of the top of piston 34 (FIG. 5).

The cross-sectional area of the recessed portion of a cylinder head at bottom 124 can be equal to, less than, or greater than the corresponding cross-sectional area of the respective underlying combustion chamber 60. In a preferred embodiment, the recessed portion of the bottom of a respective cylinder head and the recessed portion of the top of the respective cylinder head, individually, each have cross-sectional areas generally corresponding to the cross-sectional area of the corresponding underlying combustion chamber. The outer perimeter of the recessed portion of the top of the cylinder head 114 and the outer perimeter of the recessed portion of the bottom of respective cylinder head 114 are preferably in alignment with the outer perimeter of the underlying combustion chamber such that longitudinal axis "A5" (FIG. 7) also serves as a central axis of the top and bottom recessed portions of the head. It should be noted that in the assembled engine, for a given cylinder, piston axis "A3" (FIG. 5) and housing axis "A5" are generally coincident with each other.

Referring to FIG. 9, a groove 118 is preferably defined in the top of cylinder head 114, generally along a projection of the underlying cylinder wall 109. Groove 118 preferably substantially encompasses the perimeter of the recessed portion of cylinder head 114. In preferred embodiments, the groove is substantially annular thus to extend entirely around the perimeter of the recessed portion, whereby the perimeter configuration of the annular groove generally corresponds to the configuration of the outline of the perimeter of the respective recessed portion of the top of the cylinder head and the perimeter of the underlying cylinder.

Groove 118 can define a substantially "U"-shaped cross-section of a portion of the top of the cylinder head, wherein an inner wall and an outer wall, in combination, define the groove therebetween. In the alternative, groove 118 can define an L-shaped structure having an outer wall only, and ending at the bottom leg of the "L" at recessed top portion 119. Thus, the inner edge of a substantially L-shaped groove is preferably coextensive with an outer perimeter/edge of the recessed portion 119 of top 122 of cylinder head 114.

Referring to FIGS. 1 and 9, an annular ring gasket 72 is preferably placed in groove 118 in a respective cylinder head 114. Groove 118 and ring gasket 72 are cooperatively sized and configured such that head 114 receives ring gasket 72 and ring gasket 72 extends from groove 118 to at least the height of the maximum diameter of outer surface 66. Ring gasket 72 preferably is comprised of a material, which is compatible with the operating conditions in combustion chamber 60. Thus, preferred materials are for example and without limitation, 4130-chrome moly, or a bronze moly such as Nicomet 2 Spindle Bronze available from Anchor Bronze & Metals Inc., Bay Village, Ohio. Nicomet 2 has a general composition of about 85 weight percent copper, about 6 weight percent tin, and about 9 weight percent nickel. Other materials useful in cylinder seals, e.g. piston rings, are known to those skilled in the art, and can thus be used for ring gaskets 72.

When engine 6 is assembled, piston assemblies 14 are contained within cylinder housing 12 as indicated at FIGS. 1–3. Cylinders 11 are sized and configured, in combination with heads 114, and inner surface 78, to receive respective pistons 34, including piston rings 36, thus to define combustion chambers 60. Combustion chambers 60 are thus, in combination, defined by piston head 38, piston rings 36, cylinder side walls 109, and inner surface 78, optionally cylinder head 114.

Pistons 34 and combustion chambers 60 extend inwardly in cylinder housing 12 from inner surface 78 such that piston heads 38 (the surface of the piston disposed toward inner surface 78 of outer housing 16) are disposed toward outer surface 66. Preferably, the inner diameter of a combustion chamber 60, e.g. at cylinder wall 109, is substantially the same as the outer diameter of a respective piston 34 at side wall 40, allowing clearance for rings 36 and corresponding reciprocal motion of the piston in the cylinder. When a piston 34 is received into a cylinder 11, piston rings 36 are in simultaneous intimate contact with both the piston 34 at corresponding ring grooves 35, and with the cylinder 11, thereby forming the generally gas-tight seal between the piston 34 and the respective cylinder wall.

In a preferred assembled embodiment of piston-driven rotary engine 6, each piston 34 is always at least partially contained within a corresponding cylinder 11 while the engine is operating. In a more preferred embodiment of engine 6, the corresponding piston rings 36 are also always at least partially contained within the cylinder, whereby each piston 34 continuously forms the bottom wall of the combustion chamber, and piston rings 36 continuously form a seal between the side wall of the cylinder and the side wall of the piston.

Referring especially to FIG. 7, cylinder housing end wall 68 is preferably parallel with and spaced from cylinder housing end wall 62. Cylinder housing end wall 68 preferably extends entirely across central opening 64 of cylinder housing body 61, thereby closing opening 64 on the respective side of housing body 61. Cylinder housing shaft 70 (FIGS. 1 and 3) is secured through mounting plate 74 (FIG. 11) to end wall 68, on the side of end wall 68 opposite central opening 64. Cylinder housing shaft 70 is preferably substantially cylindrical, and extends perpendicularly and centrally from end wall 68.

When engine 6 is assembled, ring gaskets 72 form respective seals between cylinder housing outer surface 66 and inner surface 78 of stationary outer housing 16, or between cylinder heads 114 and inner surface 78. Outer housing 16 receives cylinder housing 12 through open end 80 of the outer housing (FIG. 1). Inner surface 78 of outer housing 16 is substantially annular. Inner surface 78, and outer surface 66, are cooperatively dimensioned such that the outer diameter of cylinder housing 12 is received within outer housing 16 with outer surface 66 being within gas sealing tolerance of inner surface 78 of the outer housing. Such gas seals are provided at the respective cylinders by ring gaskets 72.

Referring to FIGS. 1, 2, and 8, exhaust ports 82 preferably comprise open and continuous channels between inner surface 78 of outer housing 16, and e.g. ambient at an exterior surface of outer housing 16. As illustrated in e.g. FIG. 8, the exhaust channels can extend through both the housing body 17A and through at least a portion of the support base 17B.

Outer housing 16 can contain more than one exhaust port 82, and the exhaust ports 82 can reside in locations different from the locations illustrated in the drawings. Further, and for example, exhaust ports 82 can lead to one or more exhaust treatment devices such as muffler, catalytic converter, or the like (not shown) before passing exhaust gases to ambient or other receptacle.

Figure 16:
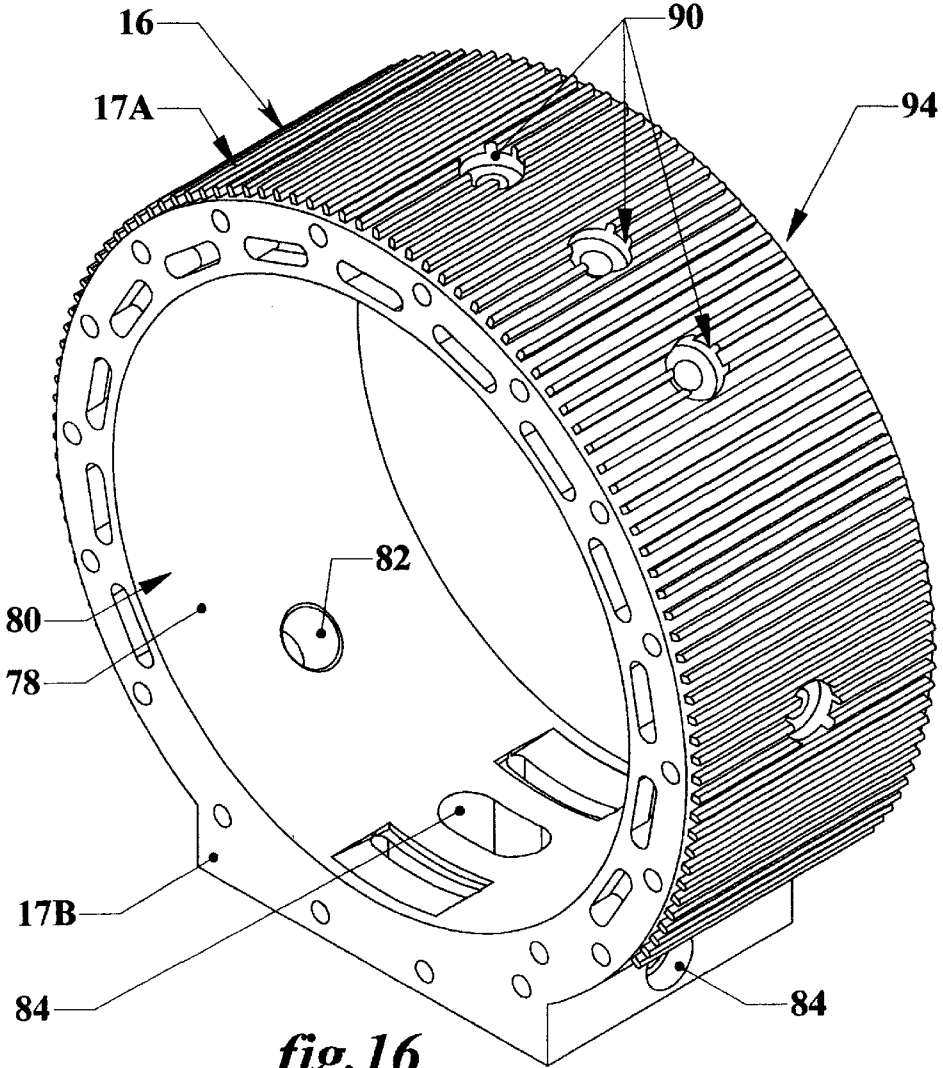
FIG. 16 shows in more detail a pictorial view of the outer housing employed in the embodiment of FIG. 10.

Intake ports 84 preferably constitute open and continuous channels between inner surface 78 of outer housing 16, and e.g. ambient at an exterior surface of outer housing 16. As illustrated in e.g. FIGS. 8 and 16, longitudinal lengths of the intake channels generally extend along arcuate inner surface 78 of outer housing 16, and extend thence outwardly of the outer housing. In FIGS. 8 and 16, intake channel 84 extends downwardly in housing 16 from inner surface 78, and transversely to the side of the outer housing, and opens there to ambient air. In the alternative, intake and/or exhaust ports can, in some embodiments, be configured for intake and/or exhaust of gases to and/or from the combustion chamber through cylinder sidewall 109 (FIG. 7).

Outer housing 16 (FIG. 16) can contain more or less than the two intake ports 84 illustrated, and intake ports 84 can reside in locations different from the locations illustrated in FIG. 1. Further intake ports 84 can lead through one or more intake treatment devices such as, for example, an air filter.

Fuel port 86 (FIG. 8) preferably constitutes an open and continuous passage between inner surface 78 and outer surface 87, of outer housing 16. Fuel port 86 is adapted to receive fuel supply component 88 (FIG. 1), for example and without limitation a fuel injector, which supply component 88 generally seals fuel port 86 and thereby controls flow of fluid through port 86. Outer housing 16 can contain more than one fuel port 86, and the fuel port 86 can reside in locations different from the location illustrated in FIG. 1.

Igniter ports 90 preferably constitute open and continuous passages between inner surface 78 and outer surface 87 of outer housing 16. Igniter ports 90 are adapted to receive igniters 92, for example and without limitation spark plugs, which igniters 92 preferably close and seal igniter ports 90. Outer housing 16 can contain more or less than the two-igniter ports shown, and igniter ports 90 can be located in locations on housing 16 different from those illustrated in the drawings.

In a preferred engine assembly, star wheel shaft 56 (FIG. 3) extends through bearing 28, and shaft 56 and bearing 28 are sized and configured for friction fit bearing engagement with each other. Bearing 28 is preferably secured within passage 26, also by a friction fit or other conventional bearing retainment. Star wheel 10 is received through opening 59 (FIG. 7) in cylinder housing end wall 62 and into central opening 64 of cylinder housing 12. Piston assemblies 14 are slidably secured at slide channels 44 to respective slide fixtures 46 on radial arms 48 of star wheel 10. Ring gaskets 72 are placed into, and are received in, respective grooves 118. The combination of cylinder housing 12 and star wheel 10 is received through open housing end 80 and into central cavity 83 (FIG. 1) of the outer housing. Cylinder housing shaft 70 extends outwardly beyond outer housing end 94. Offset plate 8 is secured to outer housing 16 at end 80 by e.g. bolts 79 (FIG. 2) employing holes 85, 89 (FIGS. 1, 4), thus providing a closure to end 80 of outer housing 16, and corresponding closure of the engine at end 80.

FIG. 2 is a partially cut-away end view of an assembled piston-driven rotary engine represented by the elements shown in FIG. 1. Selected components enumerated and discussed with reference to FIG. 1 have been identified by their corresponding reference numbers in FIG. 2, for reference and clarity.

FIG. 3 is a cross-section of engine 6, with the cut extending along the lengths of shafts 56, 70. Star wheel shaft 56 is mounted to and extends from the body of star wheel 10, and further extends out through offset plate 8. Cylinder housing shaft 70 is mounted to and extends from cylinder housing 12 at end wall 68 and further extends out through outer housing 16. As indicated above, the centerline and axis of rotation of star wheel shaft 56 is shown as "A4." The centerline and axis of rotation of cylinder housing shaft 70 is shown as "A6." The distance between respective axes "A4" and "A6" is distance "D1". Thus, the axis of rotation of star wheel shaft 56 is spaced a distance "D1" from the axis of rotation of cylinder housing shaft 70 while star wheel 10 is rotating within central opening 64 of the simultaneously rotating cylinder housing 12.

Since star wheel shaft 56 is spaced a distance "D1" from cylinder housing shaft 70, when star wheel 10 and cylinder housing 12, and correspondingly shafts 56 and 70, rotate in unison, thereby rotating cylinder housing 12 within stationary outer housing 16, pistons 34 move up and down in the cylinders by distances corresponding to distance "D1." Therefore, distance "D1" between axes "A4" and "A6" controls the magnitudes of the (up and down) strokes of the pistons and, together with the structures of combustion chambers 60, controls the compression ratios in the combustion chambers, e.g. the ratios of the largest volume of empty space within a combustion chamber 60 to the smallest volume of empty space within the respective combustion chamber, during rotation of cylinder housing 12 and star wheel 10 in the outer housing.

As shown in FIG. 3, cylinder housing shaft 70 preferably is mounted to mounting plate 74 and extends outwardly of outer housing 16 through aperture 98 in the outer housing, and thence through central aperture 95 of hub 96 thereby to define an open channel 104 which extends as a continuous passageway through outer housing 16 and hub 96. Bearing 106 is disposed in central aperture 95 of hub 96 such that the resulting net channel 104 represents central alignment of aperture 98 and bearing 106.

Referring, now, to FIGS. 1–3, after assembly, the engine generally works as follows. Star wheel 10 is rotated, preferably by applying rotational force to the cylinder housing through shaft 70, such as by rotating a starter motor (not shown) coupled to shaft 70. Because the piston assemblies 14 are slidably mounted on star wheel 10 at slide fixtures 46, piston assemblies 14 rotate with star wheel 10. Pistons 34 are correspondingly received in respective cylinders 11, and move up and down in the cylinders during engine rotation, by distances corresponding to distance "D1." As the pistons 34 rotate with star wheel 10, the interaction of piston rings 36 and piston side walls 40 with cylinder side wall 109 imposes a rotational force on the cylinder housing causing the cylinder housing to rotate, with star wheel 10 and piston assemblies 14, within outer housing 16. The star wheel 10, shaft 56, piston assemblies 14, cylinder housing 12, and cylinder-housing shaft 70 thus preferably rotate in cooperative unison.

FIG. 3 further illustrates the "D1" offset of central axis "A4" of star wheel shaft 56 from central axis "A6" of cylinder housing shaft 70. With the distance between axis "A4" of star wheel 10 and heads 38 of pistons 34 fixed, but with piston rods 32 sliding on slide fixtures 46, pistons 34 travel in elliptical paths as star wheel 10 rotates around axis "A4." Combustion chambers 60 within cylinder housing 12 travel in substantially circular paths as cylinder housing 12 rotates around axis "A6" of cylinder housing shaft 70. Distance "D1" between axes "A4" and "A6," plus the sliding action of rods 32 on slide fixtures 46, establishes the pistons 34 traveling in the above noted elliptical paths, which are non-concentric with the related circular paths traversed by combustion chambers 60. Assuming, for example, that the engine is oriented such that axis "A4" is e.g. vertically offset a distance "D1" above axis "A6," pistons 34 within the respective combustion chambers 60 are closest to annular inner surface 78 as they rotate past the uppermost arc of inner surface 78, and are furthest from inner surface 78 as they rotate past the lowermost arc of the inner surface. FIG. 2 illustrates such vertical displacement of axes "A4," "A6," and the corresponding affect on piston movement within the cylinders.

For purposes of discussion, the locus at which a piston 34 is closest to inner surface 78 of outer housing 16, is referred to herein as the compression locus, and the point at which a piston 34 is furthest from inner surface 78 is referred to herein as the expansion locus. Pistons 34 being rotated from the expansion locus to the compression locus are in the compression phase of operation of the respective combustion chamber, progressively approaching or compressing toward inner surface 78. Pistons 34 being rotated from the compression locus to the expansion locus are in the expansion phase, progressively expanding or receding away from inner surface 78.

As cylinder housing 12 rotates with the star wheel and the piston assemblies, air is introduced into each combustion chamber 60 through intake ports 84 in outer housing 16 as the respective combustion chamber rotates past the intake ports. Air enters the respective combustion chamber 60 when the combustion chamber comes into alignment with an intake port 84 during cylinder housing rotation. The top of each combustion chamber 60 is open to fluid communication at outer surface 66 of the cylinder housing, optionally through recess 108 and/or passages 116, thus allowing air to enter the combustion chamber through outer surface 66 when the chamber 60 is aligned with the intake ports.

In some embodiments, intake ports 84 are positioned in outer housing 16 such that air is introduced into the combustion chamber 60 after the respective piston 34 has substantially receded from inner surface 78 in the expansion phase. To the extent the respective piston recedes from inner surface 78 during air intake, the recession creates a relative vacuum, or negative air pressure, condition in the combustion chamber. As the cylinder rotates to and past the intake ports during ongoing recession, ambient air pressure outside the cylinder forces a fresh charge of air into the combustion chamber through intake ports 84.

As the cylinder housing 12 rotates out of alignment with intake ports 84 in outer housing 16, air becomes trapped within respective combustion chambers 60. Piston rings 36 form relatively gas-tight seals between the side walls of pistons 34 and corresponding walls 109 of the respective cylinders, thereby providing a lower gas-tight seal for a cross-section of the respective combustion chamber 60. In addition, ring gaskets 72 form relatively gas-tight seals between inner surface 78 of outer housing 16 and cylinder housing outer surface 66 at combustion chambers 60. As cylinder housing 12 continues to rotate, respective combustion chambers 60 sequentially move into and out of alignment with a section 100 of inner surface 78, of outer housing 16, which section has no open passages to the exterior of outer housing 16. In such alignment, a respective combustion chamber 60 and ring gasket 72 trap the ingested intake air between the inner surface 78 and the seal formed by the respective piston and piston rings 36, thereby to define the closed and sealed combustion chamber defined generally by piston 34, the cylinder side walls 109, and inner surface 78 of the outer housing, making allowance for cylinder head 114 (FIG. 9) where such cylinder head is used.

Fuel is injected or drawn into the respective closed and sealed combustion chamber through fuel port 86. Fuel can be injected or drawn into a respective combustion chamber 60 along with, or separate from, the intake air. The fuel can be selected from a wide variety of combustible liquids, e.g. gasoline, diesel fuel, butane, or liquid propane, or combinations of liquid fuels. In the alternative, the fuel can be selected from a wide variety of combustible gases, such as natural gas, methane gas, propane gas, or mixtures of these or other suitable combustible gases.

Piston 34 in the compression phase compresses the intake air and any fuel enclosed within the respective chamber 60. The respective piston compresses the enclosed air and/or fuel as the piston moves upwardly the distance e.g. "D1" toward outer housing 16 as the piston rotates in the elliptical path about axis "A4," and thereby reduces the sealed volume within the respective chamber 60. The piston thus compresses the air or air/fuel mixture within the enclosed and sealed combustion chamber 60 while the piston travels through the compression phase of its rotating path.

At or near the compression locus, where the highest compression is obtained, the closed and sealed combustion chamber 60 comes into alignment with one or more igniters 92. The igniters form a spark or sparks, or other form of ignition initiation within the respective sealed chamber 60, causing the enclosed and trapped fuel/air mixture to ignite. Ignition of the fuel/air mixture generally originates at the location of the spark, and propagates thence throughout the closed and sealed combustion chamber. In a preferred embodiment, the ignition of the fuel/air mixture originates in the recessed portion of top wall 122 of a cylinder head 114, and propagates through passages 116 to that portion of the combustion chamber which lies between the cylinder head and the piston as sealed by rings 36.

The heat of ignition causes the fuel/air mixture and the corresponding combusted gases within the combustion chamber 60 to expand, resulting in internal forces being applied to all surfaces within the respective sealed combustion chamber 60. The internal expansion force against the piston head 38 is transferred by way of piston rod 32 through respective piston assembly 14, slide channel 44, and slide fixture 46, to a respective radial arm 48 of star wheel 10. The force exerted on the respective radial arm 48 is displaced from and transverse to axis "A4" of star wheel shaft 56 and thus applies a rotational force, related to the distance of such displacement, to star wheel 10, urging rotation of star wheel 10 about shaft 56. Such rotation of star wheel 10 is driven by expansion of the mixture of fuel, air, and combustion gases in the respective combustion chamber 60, as the expanding combustion gases push the piston away from inner surface 78. Expansion of the burning fuel/air mixture continues while the piston is in the expansion phase and sustaining a positive gaseous pressure within the combustion chamber. This process is preferably repeated in each combustion chamber 60, for every revolution of cylinder housing 12.

Engine 6 may also include a pre-combustion chamber (not shown). The pre-combustion chamber is preferably positioned at or near the compression locus, preferably in outer housing 16. For example, a fuel/air mixture is introduced into the pre-combustion chamber. Igniter 92 ignites the fuel/air mixture, causing the ignited fuel/air mixture and the flame front to move into a respective associated main body of the combustion chamber 60. The expanding mixture of fuel, air, and gases of combustion, within the respective combustion chamber 60 provides the internal force described above.

At some point preferably during the expansion phase, and more preferably near the expansion locus, the combustion chamber becomes aligned with one or more exhaust ports 82 in outer housing 16. The expanding mixture of fuel, air, and gases of combustion in the combustion chamber escapes from the combustion chamber due to the relatively higher pressure in the combustion chamber relative to ambient, through exhaust ports 82 when the respective combustion chamber comes into alignment with exhaust ports 82. Once the mixture of gases escapes from the combustion chamber through exhaust ports 82, the respective piston 34 is no longer under power. Namely, there is no longer any expanding gaseous mixture pushing against piston head 38. Accordingly, piston 34 is under power from where the gases are ignited at igniter 92 until the combustion chamber comes into alignment with exhaust ports 82.

In light of the above, and as illustrated in the various drawings, multiple pistons 34 can be simultaneously under power in the expansion, power phase of the rotary cycle of the engine. Even when a respective combustion chamber passes the expansion locus and begins the compression phase of the cycle, if combustion gases remain in the combustion chamber, e.g. the exhaust port has not been reached, then the piston remains under pressure.

Further to the driving of shaft 56, at all phases of the rotation of a cylinder about its circular path, whether under compression or under power, any gaseous pressure encountered in the combustion chamber and applied to the piston causes the piston to apply downward pressure on the respective slide fixture 46, thus contributing to the force driving shaft 56 on the star wheel in the active direction of rotation. Thus, when the piston is in the compression phase of its cycle, the compression force inside the cylinder applies downward force through piston rod 32 to slide fixture 46, thus cumulatively adding to the force driving shaft 56.

Engine 6 is configured such that the internal gas pressures within respective sealed combustion chambers 60 in the compression phase create forces on respective piston assemblies 14 and respective radial arms 48 of star wheel 10, which forces act to apply rotational forces to rotate star wheel 10 in the same direction as the star wheel rotation urged by the expansive force of the ignited fuel/air mixture.

As or after the combusted gas mixture is generally exhausted through exhaust ports 82, respective combustion chambers 60 come into alignment with intake ports 84 to repeat the compression, ignition, and expansion phases of the cycle.

While cylinder housing 12 rotates, piston assemblies 14 within cylinder housing 12 move linearly along the lengths of slide flanges 47 and thus move with respect to radial arms 48 of star wheel 10. In preferred embodiments, a piston assembly 14 slides or rolls on a respective slide fixture 46 secured or connected to a respective radial arm 48 of star wheel 10. By being free to move along a flange 47 of a respective radial arm 48, the outer surface of the side wall 40 of the piston remains aligned with the inner surfaces of the side wall 109 of the respective combustion chamber.

In a preferred embodiment, air is introduced into respective combustion chambers 60 through intake ports 84 while respective pistons 34 are in expansion phases. The intake ports 84 are preferably located at or adjacent the expansion locus. Preferably, fuel is introduced into respective combustion chambers 60 after air has been introduced into the respective combustion chambers. However, fuel can be introduced into a combustion chamber 60 simultaneously with air.

Engine 6 preferably has at least one igniter 92 located at or adjacent the compression locus. Igniters 92 preferably provide one ignition per combustion chamber 60 per revolution of cylinder housing 12. Assuming, for example, that cylinder housing 12 contains eight cylinders 11, and thus eight combustion chambers 60, as shown, igniters 92 provide eight igniter ignitions during each revolution of cylinder housing 12.

As will be understood by review of the structure described hereinabove, the timing of ignition is controlled in part by the clock timing of activation of an igniter 92, and in part by the location of the respective igniter. As to location of the igniter, a respective igniter can initiate ignition in the combustion chamber any time the respective combustion chamber or port thereto is passing the igniter. Within the time period wherein the combustion chamber is passing the igniter, the igniter can be clocked to initiate burn at any time in that passing window so long as the igniter acts while directly or indirectly exposed to the combustion chamber for sufficient time to effectively initiate the ignition.

Thus, the timing of ignition can be controlled both by location of an igniter 92 and by timing of activation of the igniter. In preferred embodiments, two or more igniters 92 are installed in a given engine spaced from each other by no more than the radial angle defined across the diameter of the cylinder so as to always have at least one igniter 92 exposed to the combustion chamber during that portion of the path traversed by the combustion chamber during which ignition might be desired. For example, in an engine wherein the nominal outer diameter of the cylinder housing at surface 66 is 11 inches, and wherein eight cylinders are used, each about 2 inches diameter, three igniters are employed at spacings of approximately 11 degrees from each other, about the circumference of outer housing 16. In such engine, timing of ignition of the compressed fuel/air mixture within respective combustion chambers 60 can be correspondingly controlled and/or adjusted to an earlier or later time in rotation of the respective cylinder by (i) selection of which igniter is to be activated, and (ii) by selection of the exact timing of activation of the selected igniter.

Engine 6 can employ other means of fuel/air mixture ignition in place of igniters 92, for example and without limitation, glow plugs, or self-ignition also known as "dieseling."

The device generally as described above as engine 6 can also be used as a pump. In such embodiments, the fluid to be pumped is introduced into respective cylinders 11 through intake ports 84 and is pumped out of cylinders 11 at exhaust ports 82. Structures and locations of ports 82, 84 are correspondingly adjusted according to known pump technology. When the device is used as a pump, fuel inlet port 86 and igniter ports 90 are preferably sealed with suitable plugs and/or other sealant, thereby closing the respective passageways which extend from inner surface 78 to outer surface 87 of outer housing 16.

Figure 12:
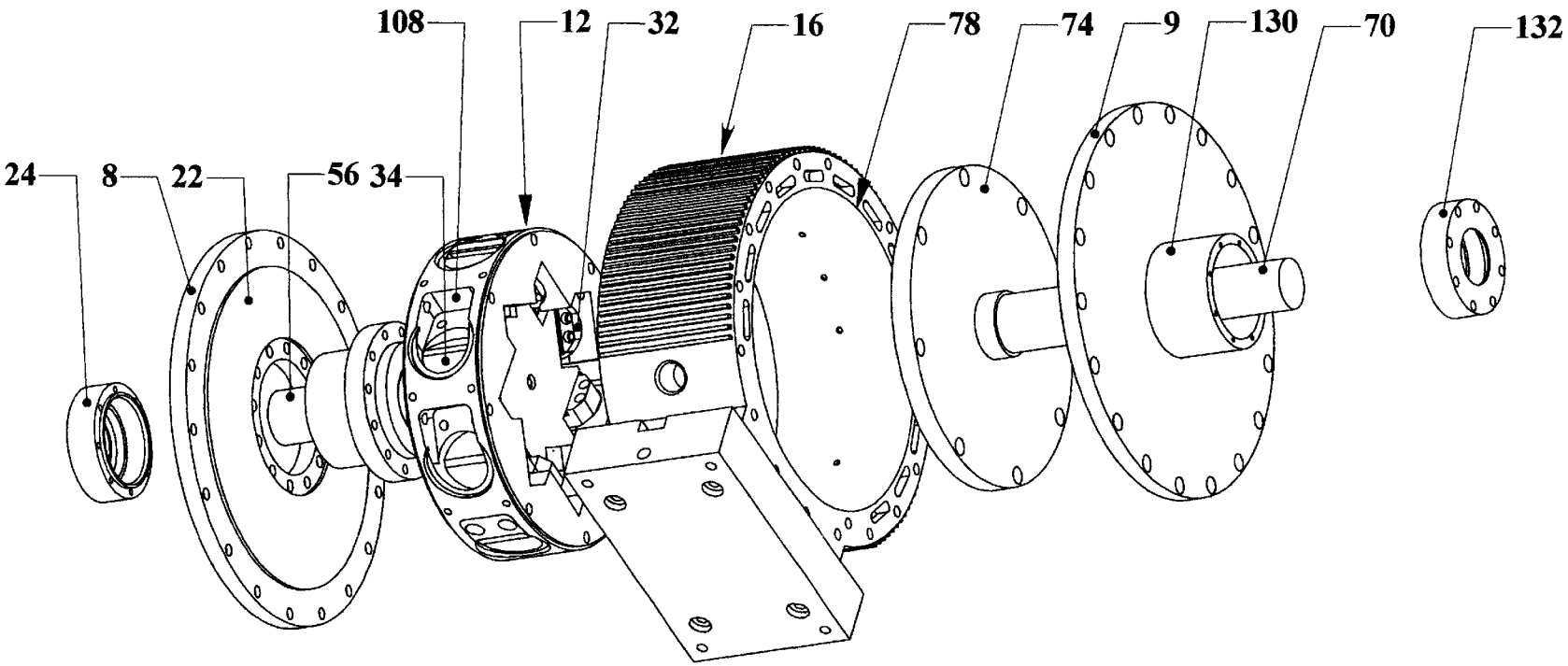
FIG. 12 shows a further pictorial right-side exploded view representation of the embodiment of FIG. 10.
Figure 13:
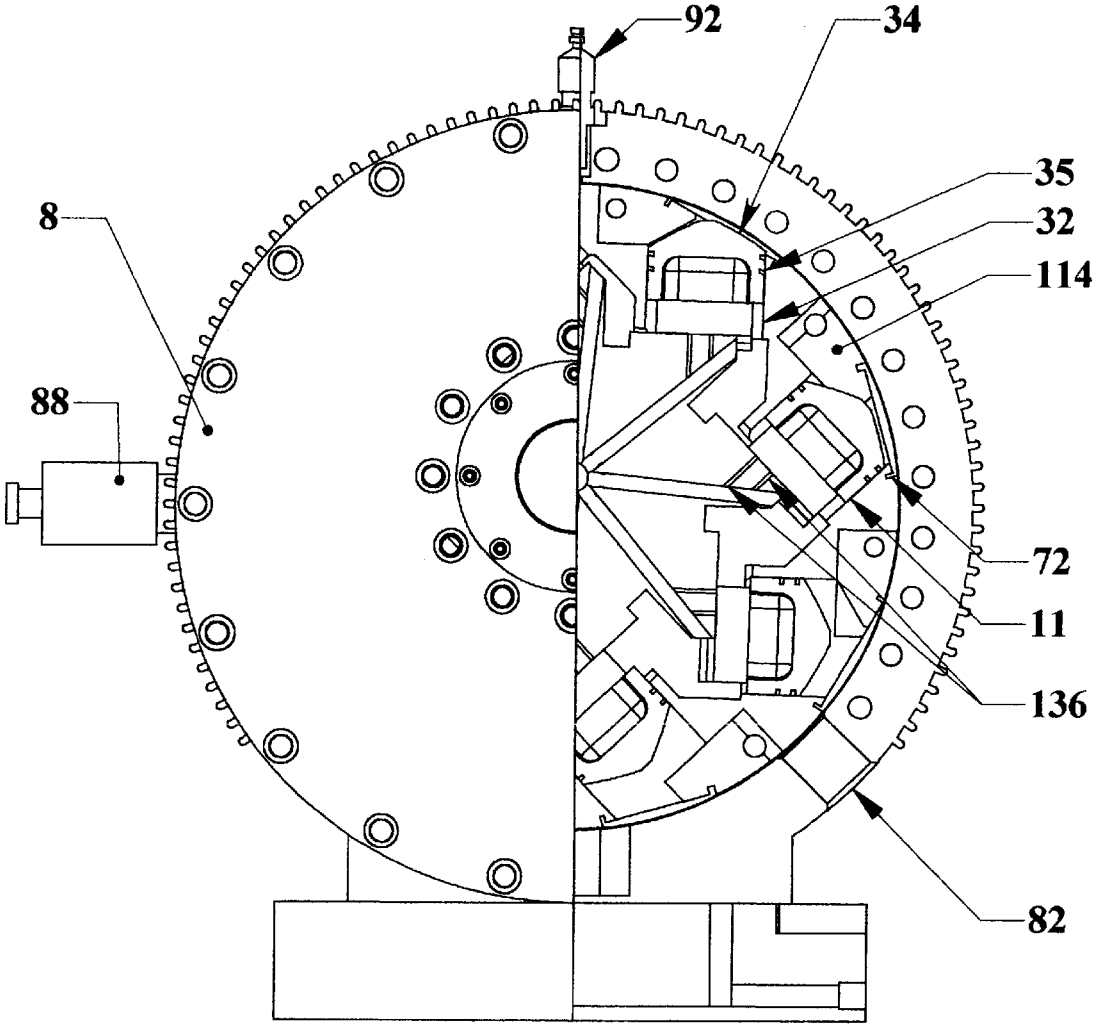
FIG. 13 is a partially cut-away end view of the embodiment of FIG. 10.
Figure 18:
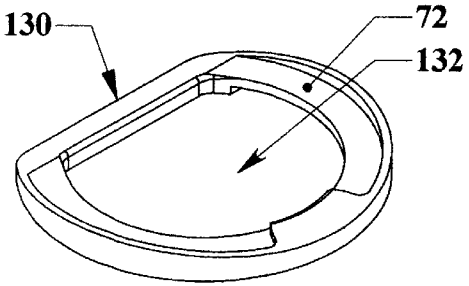
FIG. 18 shows in more detail a pictorial view of the seal ring employed in the embodiment of FIG. 10.
Figure 14:
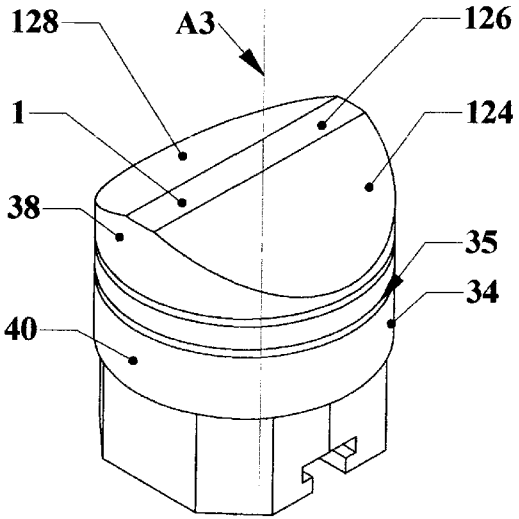
FIG. 14 shows a top pictorial view of the pistons employed in the embodiment of FIG. 10.
Figure 15:
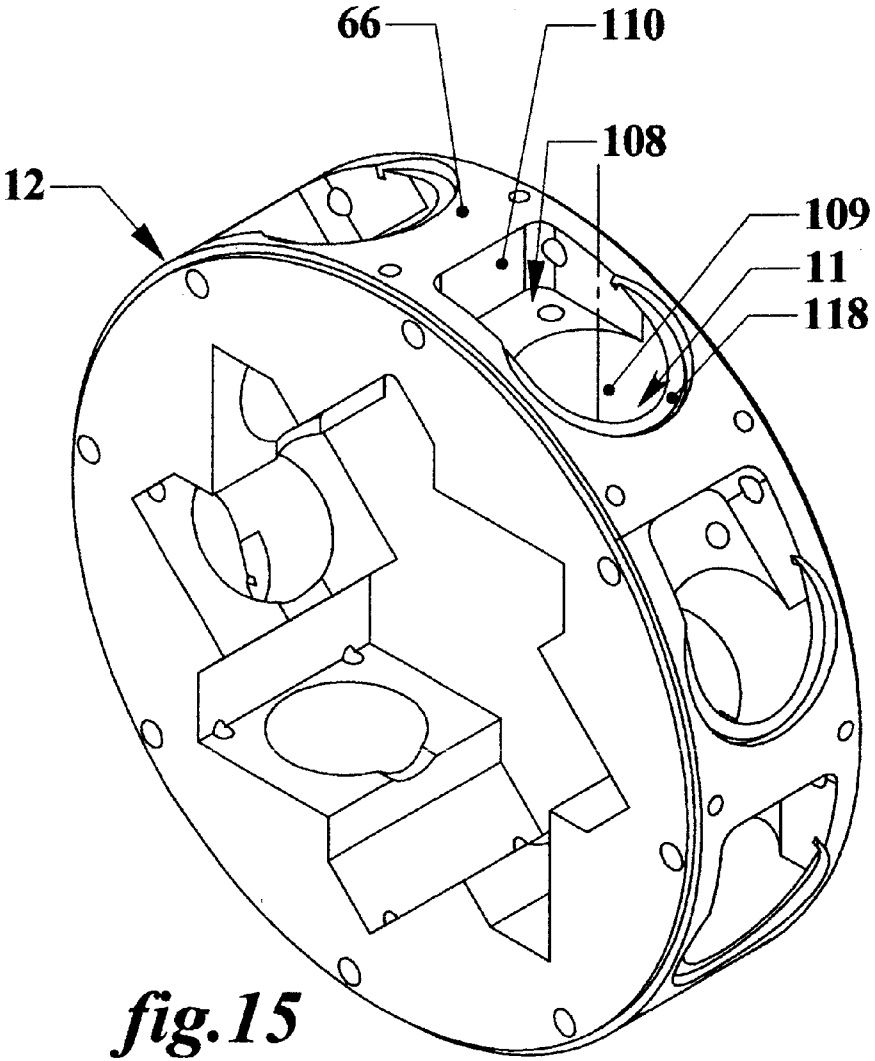
FIG. 15 shows a pictorial view of the cylinder housing assembly used in the embodiment of FIG. 10.
Figure 19:
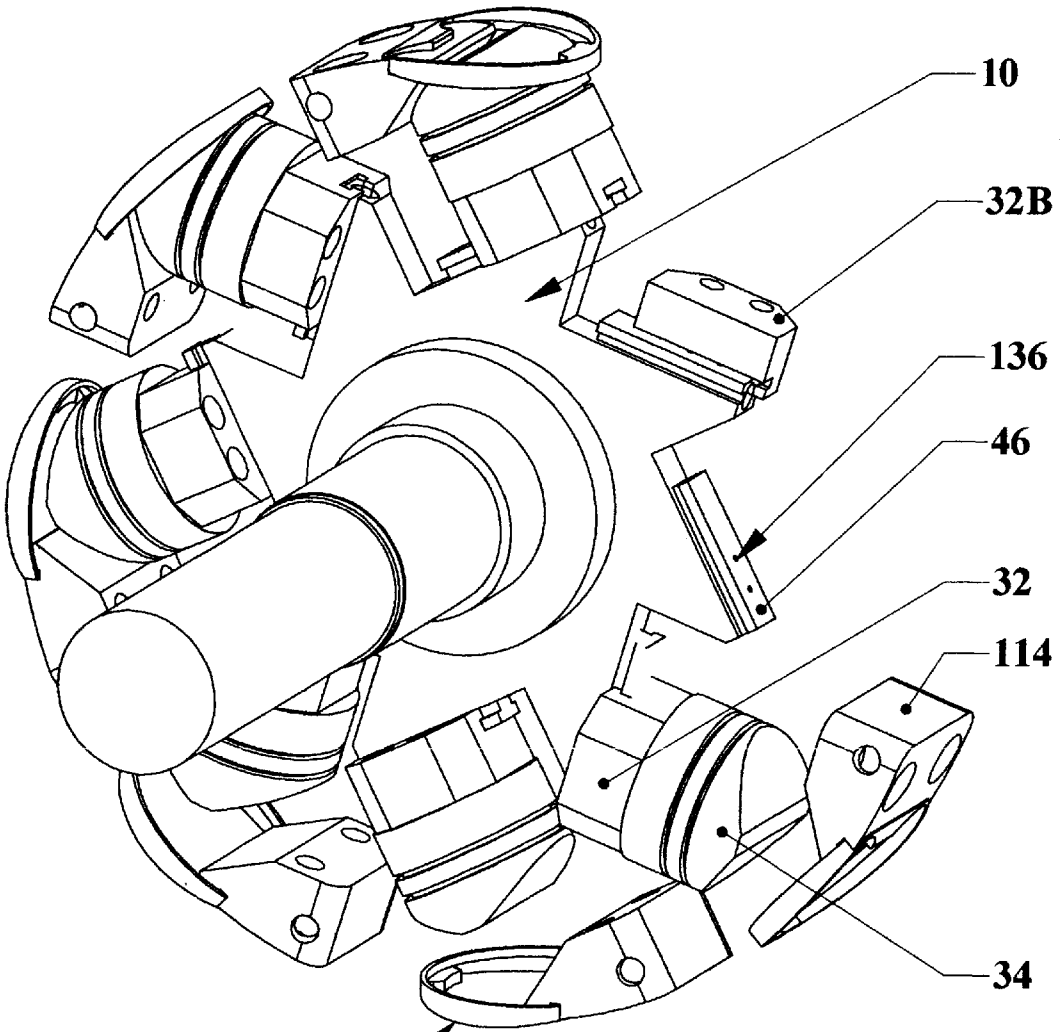
FIG. 19 shows in pictorial view a spatial array of the star wheel, in combination with some of the pistons, some of the cylinder heads, and some of the seal rings, illustrating the relative positionings of the respective elements in final assembly, but with some assembly elements missing.
Figure 20:
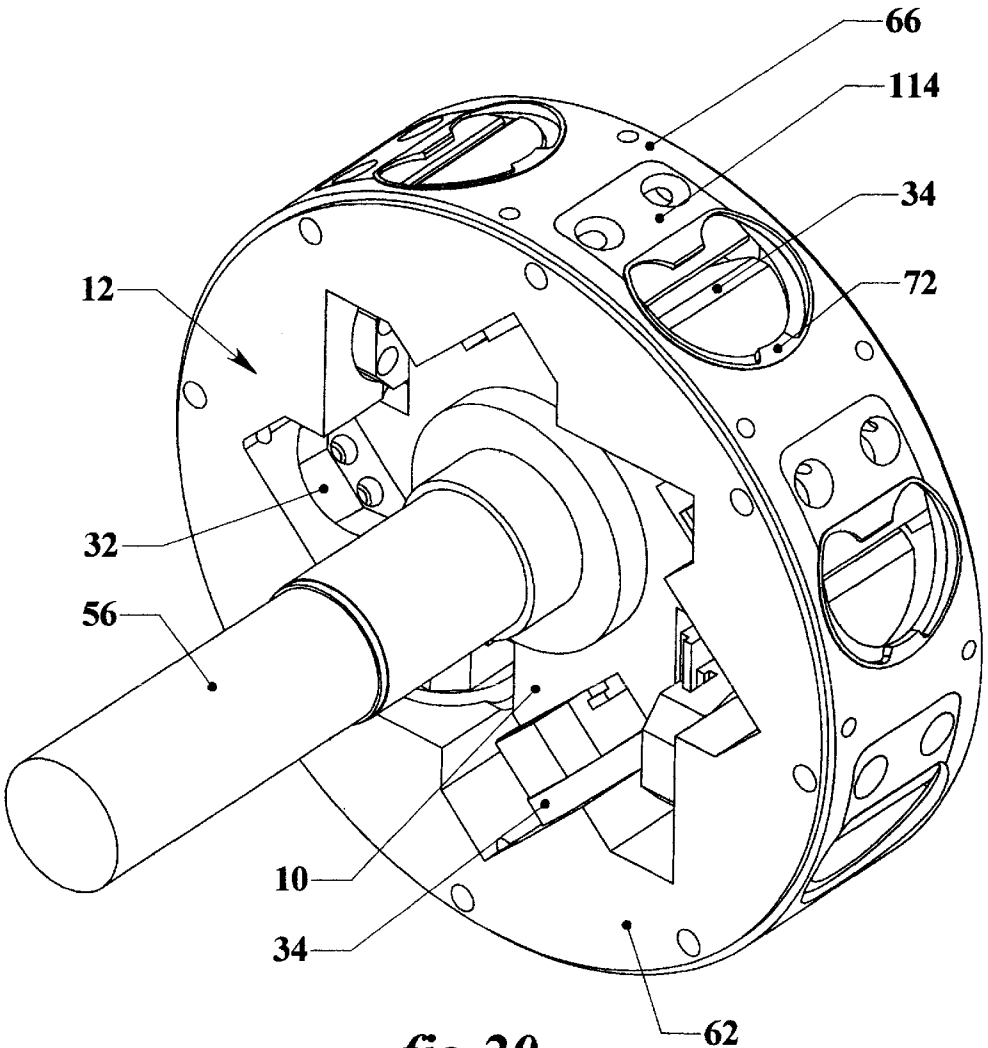
FIG. 20 shows in pictorial view a subassembly comprising the star wheel, with pistons assembled thereto, inside the cylinder housing.

FIGS. 10–21 illustrate a further family of embodiments of engine 6. Referring now especially to FIGS. 14, 15, and 20, cylinder-housing 12 is generally as shown in FIG. 7 except for the design of the cylinders and respective recesses 108. Whereas in the piston of FIGS. 5, 5B, and 7, the piston head is truncated at angled surface 124, and is flat or perpendicular to axis "A3" at surface 126 over the remaining area of the head, in the piston of FIG. 14, piston head 38 is divided into three faces. A central face 126 is perpendicular to axis "A3." Near face 124 is truncated as in the embodiment of FIG. 5. The third face 128 is also truncated at an angle from axis "A3" complementing the angle of face 124. Thus, cylinder head 38 is symmetric with respect to axis "A3" whereby the gases in combustion chamber 60 impose a balanced set of side-loading forces on the piston head, thus to generally provide a net line of driving forces, driving the piston, generally aligned with axis "A3".

Figure 17:
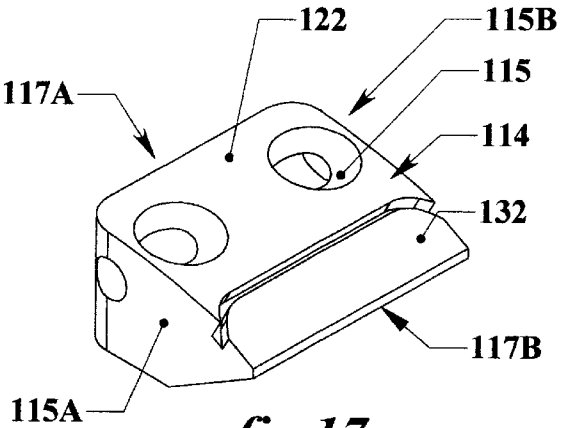
FIG. 17 shows in more detail a pictorial view of the cylinder head employed in the embodiment of FIG. 10.

Referring to FIGS. 15, 17, and 20, the top of cylinder 11 is designed to generally approach the maximum outer diameter of outer surface 66 and to generally follow the contour of the maximum outer diameter, over approximately half of the cross-sectional area of the cylinder. Recess 108 and cylinder head 114 are cooperatively configured so that cylinder head 114 generally extends over the remaining portion of the cross-sectional area of the cylinder, namely that portion of the respective cylinder 11 which does not extend generally to the maximum diameter of outer surface 66. Thus, cylinder head 114 overlies generally that portion of the cylinder cross-section not occupied by that portion of piston 34 not underlying face 124, and generally follows and complements the contour of piston face 128 and optionally part or all of face 126.

Groove 118 is defined in outer surface 66 of the cylinder housing as illustrated in e.g. FIG. 15, around approximately half of the circumference of the cylinder, generally where the cylinder intersects the maximum diameter of the cylinder housing body, and complements both faces 124 and 126 of piston head 38.

Ring gasket 72 is designed and configured in the shape of a "D" as illustrated in FIG. 18, and is hereinafter also referred to as a D-ring. D-ring 72 and groove 118 are sized and configured for mutual cooperation with each other so that D-ring 72 is sealingly received in groove 118 for sealing the joint between cylinder housing body 61 and inner surface 78 of the outer housing, at the respective portion of the cylinder representing face 124, and optionally face 126, of the piston. In that regard, the straight side 130 of D-ring 72 is seated on receiver 132 of cylinder head 114.

In the assembled configuration, substantially the entirety of central opening 134 in D-ring 72 serves as gas transmission passage for passing intake air and fuel into the cylinder and for passing exhaust gases out of the cylinder. Correspondingly, cylinder head 114 covers the remaining portion of the cross-section of the cylinder, whereby, with the piston and cylinder head, and piston and inner surface 78, representing close conformation of the piston head to the adjacent overlying surfaces, there is little void space at the top of the cylinder. In the embodiment of FIGS. 10–21, there are preferably no passages 116 through cylinder head 114. Rather, intake fluids and exhaust gases enter and exit the cylinder through central opening 134 in the D-ring. Accordingly, the embodiment of FIGS. 10–21 provides for the desired control of compression ratio without the complication of a plurality of passages 116 through cylinder head 114.

Referring to FIG. 16, outer housing 16 is shown in more detail, with relocated and reconfigured structures for intake port 84 and exhaust port 82. FIG. 16 further illustrates cooling channels 138 for passage of e.g. liquid coolant therethrough as part of a cooling system.

Figure 11:
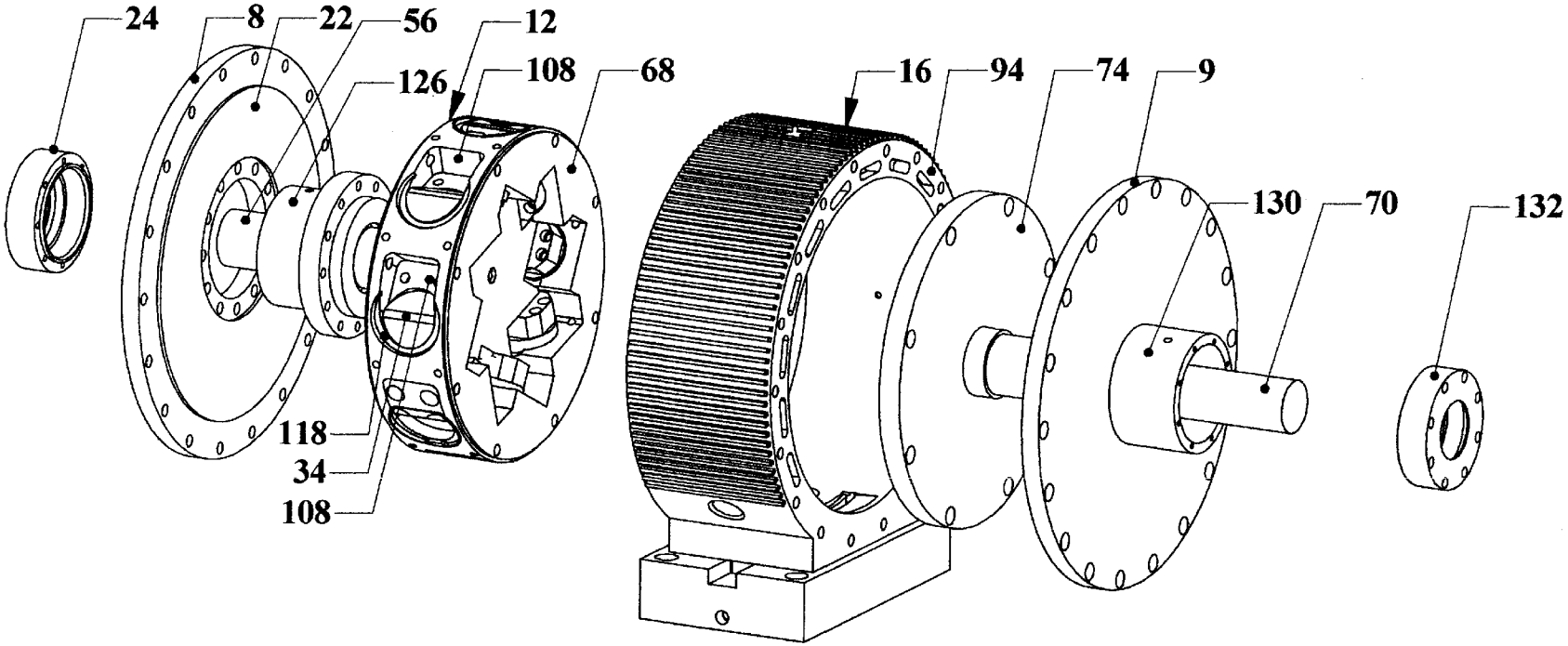
FIG. 11 shows a pictorial right-side exploded view representation of the embodiment of FIG. 10.

Referring especially to the exploded assembly drawings of FIGS. 10–12, like numbered elements represent generally the same elements as in the previously discussed embodiments. As illustrated there, in these embodiments the closure at and adjacent offset plate 8 includes an intermediate hub 126 mounted to plate 8 and outer hub 24 mounted to intermediate hub 126. Bearing 28 is mounted between, and interacts with, shaft 56 and intermediate hub 126, with outer hub 24 acting as a bearing retainer.

Further to this embodiment, end 94 of outer housing 16 is closed by closure plate 9. Referring to FIGS. 11 and 12, a second intermediate hub 130 is mounted to closure plate 9 and serves to house bearing 106 (FIG. 3). A corresponding second outer hub 132 serves as a bearing retainer.

Referring to FIGS. 6, 13, and 19, an oil line 134 extends along axis "A4" in shaft 56, feeding oil to a central locus in star wheel 10, and thence outwardly along oil lines 136 to slide fixtures 46. Oil lines 136 extend to the outer surfaces of slide flanges 47 where the oil lines provide oil for lubricating the sliding of piston rods 32 on respective slide fixtures 46, as well as providing oil to side walls 109 of cylinders 11. The turning of star wheel 10 provides centrifugal force automatically drawing the oil from a reservoir (not shown) and distributing the oil to the outer surfaces of flanges 47, thence to the cylinder walls.

Figure 21:
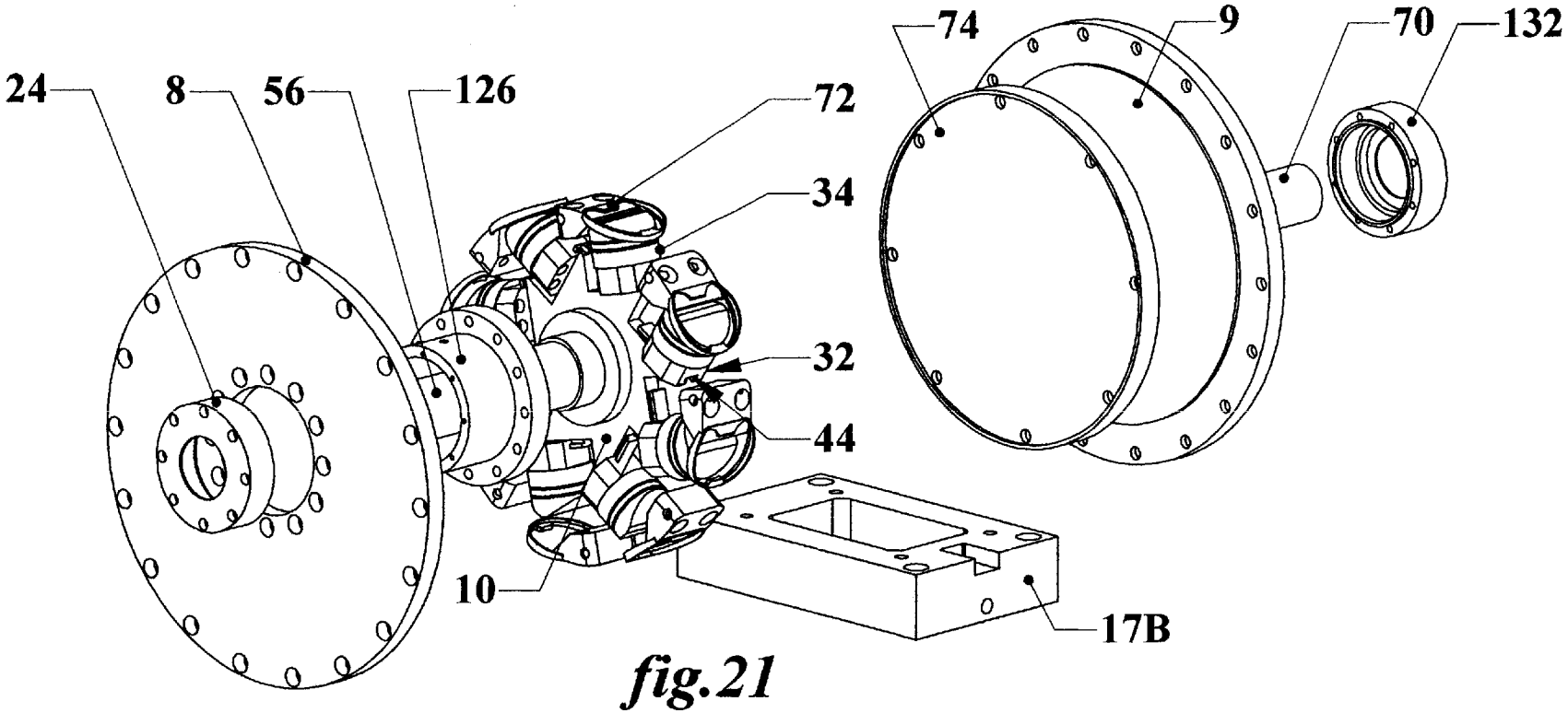
FIG. 21 shows in pictorial view an assemblage of star wheel, pistons, cylinder heads, and seal rings, in exploded view relationships with the opposing engine end closure elements, and absent the cylinder housing and outer housing.
Figure 22:
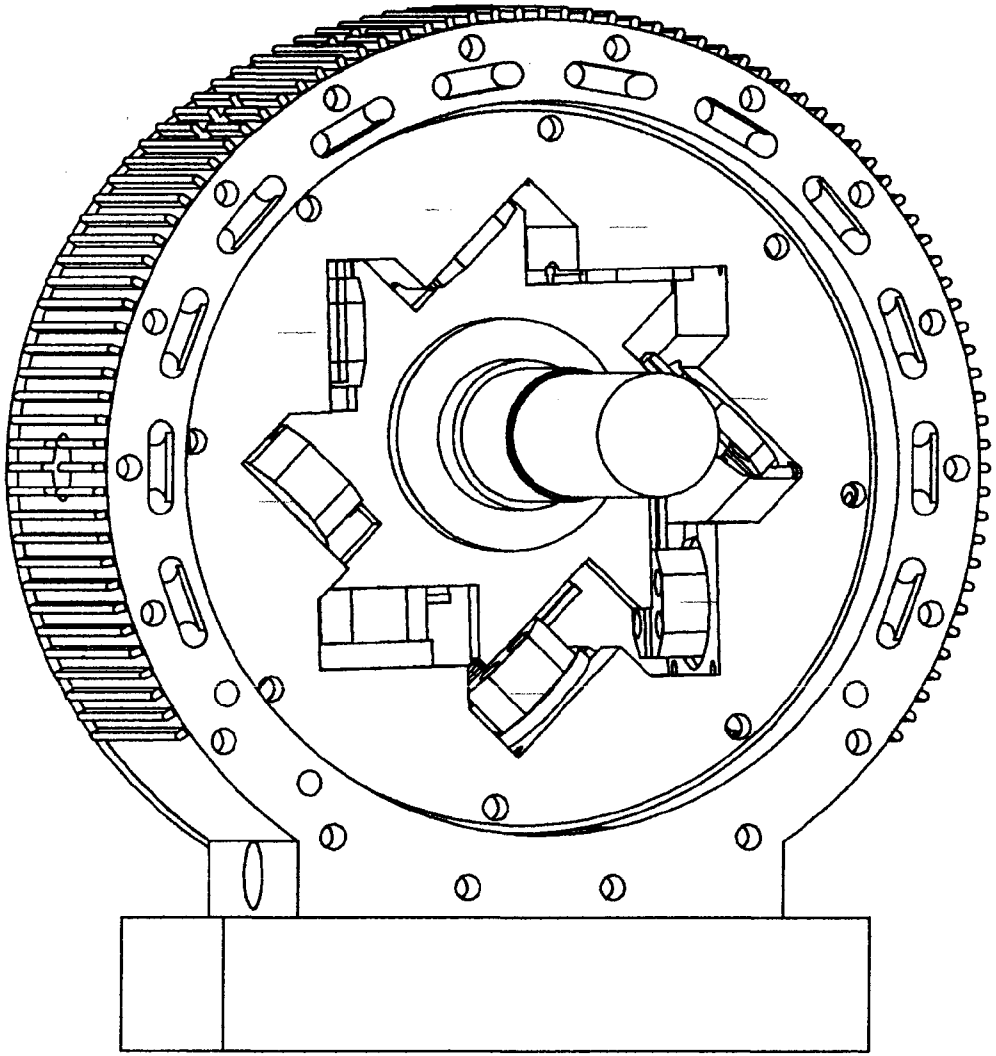
FIG. 22 is a pictorial representation of an assembly including outer housing, cylinder housing, and star wheel with pistons assembled thereto.

FIG. 21 further illustrates the star wheel assembly, including drive shaft 56, star wheel 10, pistons 34, rods 32, cylinder heads 114, and D-rings 72, all assembled together in the configuration in which received into cylinder housing 12, but with cylinder housing 12 omitted in order that the respective elements can more readily be seen. FIG. 20 adds cylinder housing 12 to the star wheel assembly, thus to show the cylinder housing assemblage as the cylinder housing assembly interfaces with outer housing 16.

In general, it is preferred that engine 6 have a relatively large power to weight ratio. Accordingly, the various elements of engine 6 should be as light in weight as possible. One way weight can be saved is by designing the several elements for maximum utilization of the strengths of the materials selected. Another way of saving weight is by materials selection. Thus, lighter density materials are generally preferred where material selection is consistent with tolerance of the operating conditions to which the respective material will be exposed. In that regard, outer housing 16, cylinder housing 12, and pistons are preferably fabricated of BORALYN® or other lightweight material. All materials known for use in engine block design (outer housing 16 and cylinder housing 12) and piston design (pistons 34) can be employed for the respective working elements of engine 6. Star wheel 10 is preferably fabricated of titanium or other lightweight material consistent with the operating conditions and structural requirements to which star wheel 10 is exposed. Offset plate 8 is preferably fabricated of aluminum or other lightweight material.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A rotary device for receiving fluid input and generating a fluid discharge therefore, said rotary device comprising:

(a) a stationary outer housing having a circumferential outer wall comprising a first outer surface and a second opposing annular inner surface;

(b) a rotatable cylinder housing positioned within said outer housing, said cylinder housing comprising a generally annular outer surface disposed toward and positioned in generally close juxtaposition with at least a portion of the second inner surface of said outer housing, said cylinder housing including a central opening therein and a plurality of open cylinders defining passages extending from the central opening generally to the outer surface of said cylinder housing, said rotatable cylinder housing defining a first central axis of rotation;

(c) a rotatable wheel positioned within said central opening, said rotatable wheel defining a second axis of rotation of said rotatable wheel displaced from the first axis of rotation; and (d) a plurality of pistons connected to said rotatable wheel, and extending into respective ones of the open cylinders thereby to define closed fluid processing chambers between said pistons and the inner surface of said outer housing, said rotatable wheel, said pistons, and said rotatable cylinder housing being cooperatively designed and configured to rotate substantially in unison within said stationary outer housing whereby said pistons move in reciprocating paths along longitudinal axes of said cylinders such that sizes of spaces within the cylinders between top sides of said pistons and the tops of said fluid processing chambers alternately increases and decreases, said rotary device further including a cylinder head in a respective said cylinder proximate the outer surface of said cylinder housing, said cylinder head comprising a solid structure having a first top side and a second generally opposing bottom side, said first top side being disposed toward said second inner surface of said outer housing.

2. A rotary device as in claim 1 wherein said outer housing includes at least one said aperture which is sized and configured to receive an igniter, said aperture being positioned proximate a compression locus of said rotary device.

3. A rotary device as in claim 2, including at least one igniter disposed in respective said igniter aperture.

4. A rotary device as in claim 1 wherein said outer housing includes at least one said aperture for intake of fresh air, at least one said aperture for intake of fuel, and at least one said aperture for exhaust of an ignited fuel/air mixture.

5. A rotary device as in claim 1 including at least one ring gasket disposed at the outer surface of said cylinder housing.

6. A rotary device as in claim 5 wherein said ring gasket substantially surrounds an opening in said outer surface of said cylinder housing, wherein said opening is defined by a respective cylinder.

7. A rotary device as in claim 6 wherein said gasket is in intimate contact with both said outer surface of said cylinder housing and said second inner surface has said outer housing.

8. A rotary device as in claim 1 wherein said rotatable wheel includes a central wheel body and at least one radial arm extending outwardly from said central wheel body, said radial arm having a first edge surface extending in a plane parallel to a tangent to said wheel body.

9. A rotary device as in claim 8 wherein said first edge surface includes a slide fixture extending along the length of said first edge surface, said slide fixture being secured to said rotatable wheel at said first edge surface.

10. A rotary device as in claim 9 wherein said rotatable wheel is substantially disc-shaped, said wheel including a first end, a second opposing end, and a third circumferential side there between, said at least one radial arm being defined in said third side, a first shaft extending outwardly from the first end, a longitudinal axis of said first shaft coinciding with the second axis of rotation.

11. A rotary device as In claim 10, the first axis of rotation being displaced from the second axis of rotation.

12. A rotary device as in claim 11 wherein the magnitude of displacement between the first and second axes of rotation determines the compression ratios in the respective cylinders.

13. A rotary device as in claim 8 wherein respective said pistons are connected to respective piston rods, said pistons, said piston rods, and the first edge surfaces, in combination, being configured such that a force applied by a fluid on a top of a respective said piston is directed at said first edge surface of the corresponding radial arm at an angle of at least 75 degrees with respect to the first edge surface.

14. A rotary device as in claim 8 wherein respective said pistons are connected to respective piston rods, said pistons, said piston rods, and the first edge surfaces, in combination, being configured such that a force applied by a fluid on a top of a respective said piston is directed at said first edge surface of the corresponding radial arm at an angle perpendicular to the first edge surface.

15. A rotary device as in claim 8 wherein said rotary device is configured such that an expansive force, associated with a fluid being compressed in a respective fluid processing chamber while the respective piston is in a compression phase of rotation of said cylinder housing, urges said wheel in the same rotational direction as an expansive force associated with an expanding gas trapped within the fluid processing chamber while the respective said piston is in an expansion phase of rotation of said cylinder housing.

16. A rotary device as in claim 1, said cylinder head including at least one aperture forming an open passage from said first top side to said second bottom side.

17. A rotary device as in claim 1 wherein said cylinder head occupies a cross-sectional area of such chamber.

18. A rotary device for receiving fluid input and generating a fluid discharge therefrom, said rotary device comprising:

(a) a stationary outer housing having a circumferential outer wall comprising a first outer surface and a second opposing annular inner surface;

(b) a rotatable cylinder housing positioned within said outer housing, said cylinder housing comprising a generally annular outer surface disposed toward and positioned in generally close juxtaposition with at least a portion of the inner surface of said outer housing, said cylinder housing including a central opening therein and a plurality of open cylinders defining passages extending from the central opening generally to the outer surface of said cylinder housing;

(c) a rotatable wheel positioned within said central opening, said rotatable wheel having a wheel axis of rotation defined therein, a central body portion, and a plurality of radial arms extending outwardly from said central body portion; and (d) a plurality of pistons connected to respective ones of said radial arms, and received in respective ones of said cylinders, thereby to define closed fluid processing chambers between said pistons and the inner surface of said outer housing, said rotatable wheel, said pistons, and said rotatable cylinder housing being cooperatively designed and configured to rotate substantially in unison within said stationary outer housing, each said radial arm includes a first edge surface extending in a plane parallel to a tangent to said wheel body, each said first edge surface includes a slide fixture extending along the length of the respective said first edge surface, said slide fixtures being secured to said rotatable wheel at said first edge surfaces.

19. A rotary device as in claim 18 wherein said outer housing includes at least one aperture sized and configured to receive an igniter, said aperture being positioned at or adjacent a compression locus of said rotary device.

20. A rotary device as in claim 18, including at least one igniter disposed in 8 respective said igniter aperture.

21. A rotary device as in claim 18 wherein said outer housing includes at least one aperture for intake of fresh air into said fluid processing chambers, at least one aperture for intake of fuel into said fluid processing chambers, and at least one aperture for exhaust of ignited fuel/air mixtures from said fluid processing chambers.

22. A rotary device as in claim 18 wherein said rotatable wheel is substantially disc-shaped, said wheel including a first end, a second opposing end, and a third circumferential side there between, said radial arms being defined in said third side, a wheel shaft extending outwardly from the first end, a longitudinal axis of said wheel shaft coinciding with the axis of rotation of said wheel.

23. A rotary device as in claim 22 wherein said cylinder housing defines an additional housing axis of rotation displaced from the wheel axis of rotation.

24. A rotary device as in claim 23 wherein the magnitude of the displacement between the wheel axis of rotation and the housing axis of rotation determines the compression ratios in the respective cylinders.

25. A rotary device as in claim 18 wherein respective said pistons are connected to respective piston rods, said pistons, said piston rods, and the first edge surfaces, in combination, being configured such that a force applied by a fluid on a top of a respective said piston is directed at said first edge surface of the corresponding radial arm at an angle perpendicular to the first edge surface.

26. A rotary device as in claim 18 wherein respective said pistons are connected to respective piston rods, said pistons, said piston rods, and the first edge surfaces, in combination, being configured such that a force applied by a fluid on a top of a respective said piston is directed at said first edge surface of the corresponding radial arm at an angle of at least 75 degrees to the first edge surface.

27. A rotary device as in claim 18 wherein said rotary device is configured such that an expansive force, associated with a fluid being compressed in a respective fluid processing chamber while the respective piston is in a compression phase of rotation of said cylinder housing, urges said wheel in the same rotational direction as an expansive force associated with an expanding gas trapped within the fluid processing chamber, while the respective said piston is in an expansion phase of rotation of said cylinder housing.

28. A rotary device as in claim 18, including a cylinder head in respective said cylinders proximate the outer surface of said cylinder housing, said cylinder heads each comprising solid structure having a first top side and a second generally opposing bottom side, said first top side being disposed toward said second inner surface of said outer housing.

29. A rotary device as in claim 28 wherein said cylinder heads occupy cross-sectional areas of such chambers.

30. A rotary device as in claim 18, including ring gaskets extending about perimeters of said cylinders at tops of said cylinders, and interfacing with the inner surface of said outer housing.

31. A rotary internal combustion engine, comprising:

(a) a stationary outer housing having a circumferential outer wall comprising a first outer surface and a second opposing annular inner surface;

(b) a rotatable cylinder housing positioned within said outer housing, said cylinder housing comprising a generally annular outer surface disposed toward and positioned in generally close juxtaposition with at least a portion of the second inner surface of said outer housing, said cylinder housing including a central opening therein and a plurality of open cylinders defining passages extending from the central opening generally to the outer surface of said cylinder housing;

(c) a rotatable wheel positioned within the central opening;

(d) a plurality of pistons connected to said rotatable wheel and extending into respective ones of the open cylinders thereby to define closed combustion chambers between said pistons and the inner surface of said outer housing;

(e) a cylinder head in said cylinder housing associated with each said cylinder at or adjacent the outer surface of said cylinder housing, each respective cylinder head comprising solid structure disposed between the inner surface of said outer housing and a portion of the top of the respective piston;

(f) a ring gasket disposed at the outer surface of said cylinder housing;

(g) said wheel includes a central body and a plurality of radial arms extending outwardly from said wheel body, said radial arms comprising first edge surfaces extending in planes parallel to tangents to said wheel body; and (h) each said first edge surface includes a slide fixture extending along the length of the respective said first edge surface, said slide fixtures being secured to the respective said first edge surfaces.

32. An engine as in claim 31 wherein said rotatable inner housing, said wheel, said piston, and said porous head rotate substantially in unison within said stationary outer housing whereby said pistons move in reciprocating paths along longitudinal axes of said cylinders such that spaces within the cylinders between top ends of said pistons and the tops of said combination chambers alternately increase and decrease.

33. An engine as in claim 32 wherein said rotatable wheel is substantially disc-shaped, said wheel defining a wheel axis of rotation, said wheel including a first end, a second opposing end, and a third circumferential side there between, said at least one radial arm being defined in said third side, a first shaft extending outwardly from the first end, a longitudinal axis of said first shaft coinciding with the wheel axis of rotation.

34. An engine as in claim 33 wherein said cylinder housing defines a housing axis of rotation, the housing axis of rotation being displaced from the wheel axis of rotation.

35. An engine as in claim 34 wherein the magnitude of the displacement between the wheel axis of rotation and the housing axis of rotation determines the compression ratios in the respective cylinders.

36. An engine as in claim 31 wherein respective said pistons are connected to respective piston rods, and said piston rods are connected to the first edge surfaces of said radial arms, and said pistons, said piston rods, and the first edge surfaces are, in combination, configured such that a force applied by combusting fuel on a top of a respective said piston in the combustion chamber, is directed at the respective first edge surface of the corresponding radial arm at an angle of at least 75 degrees with respect to the respective first edge surface.

37. An engine as in claim 31 wherein respective said pistons are connected to respective piston rods, and said piston rods are connected to the first edge surfaces of said radial arms, and said pistons, said piston rods, and the first edge surfaces are, in combination, configured such that a force applied by combusting fuel on a top of a respective said piston in the combustion chamber, is directed at the respective first edge surface of the corresponding radial arm at an angle perpendicular to the respective first edge surface.

38. An engine as in claim 31 wherein said rotary device is configured such that an expansive force, associated with intake gases being compressed in a respective combustion chamber while the respective piston is in a compression phase of rotation of said cylinder housing, urges said wheel in the same rotational direction as an expansive force associated with expanding gases of combustion trapped within the combustion chamber while said piston is in an expansion phase of rotation of said cylinder housing.

39. An engine as in claim 31 wherein said ring gasket substantially surrounds an opening in the outer surface of said cylinder housing and wherein said opening is defined at least in part by a respective said cylinder.

40. A rotary device for receiving fluid input and generating a fluid discharge therefrom, said rotary device comprising:

(a) a stationary outer housing having a circumferential outer wall comprising a first outer surface and a second opposing annular inner surface;

(b) a rotatable cylinder housing positioned within said outer housing, said cylinder housing comprising a generally annular outer surface disposed toward and positioned in generally close juxtaposition with at least a portion of the second inner surface of said outer housing, said cylinder housing including a central opening therein and a plurality of open cylinders defining passages extending from the central opening generally to the outer surface of said cylinder housing;

(c) a rotatable wheel positioned within said central opening, said rotatable wheel having a central wheel body and a plurality of radial arms extending outwardly from said central wheel body; and (d) a plurality of pistons connected to respective said radial arms for engagement with said radial arms, said rotatable cylinder housing, said rotatable wheel, and said pistons rotate in a common rotation about a common central axis within said stationary outer housing thereby to define closed fluid processing chambers between said pistons and the inner surface of said outer housing; respective said pistons are connected to respective piston rods, said piston rods are connected to the first edge surfaces of said radial arms, and said pistons, piston rods, and the first edge surfaces are, in combination, configured such that a force applied by a fluid on a top of a respective said piston is directed at the respective first edge surface of the corresponding radial arm at an angle of at least 75 degrees with respect to the respective first edge surface.

41. A rotary device as in claim 40 wherein said rotatable wheel is substantially disc-shaped, said wheel defining a wheel axis of rotation, said wheel including a first end, a second opposing end, and a third circumferential side therebetween, said at least one radial arm being defined in said third side, a first shaft extending outwardly from the first end, a longitudinal axis of said first shaft corresponding with the wheel axis of rotation.

42. A rotary device as in claim 41 wherein said cylinder housing defines a housing axis of rotation, the housing axis of rotation being displaced from the wheel axis of rotation.

43. A rotary device as in claim 42 wherein the magnitude of the displacement between the housing axis of rotation and the wheel axis of rotation determines the compression ratios in the respective cylinders.

44. A rotary device as in claim 40 wherein said rotary device is configured such that an expansive force, associated with a fluid being compressed in a respective fluid processing chamber while the respective said piston is in a compression phase of rotation of said cylinder housing, urges said wheel in the same rotational direction as an expansive force associated with an expanding gas trapped within the fluid processing chamber while the respective said piston is in an expansion phase of rotation of said cylinder housing.

45. A rotary device as in claim 40, including a cylinder head in a respective said cylinder proximate the outer surface of said cylinder housing, said cylinder head comprising a solid structure having a first top side and a second generally opposing bottom side, said first top side being disposed toward said second inner surface of said outer housing.

46. A rotary device as in claim 40 and including a ring gasket substantially surrounding an opening in the outer surface of said cylinder housing and wherein said opening is defined at least in part by a respective said cylinder.

* * * * *